US011443683B2

(12) United States Patent
Kim et al.

(10) Patent No.: US 11,443,683 B2
(45) Date of Patent: Sep. 13, 2022

(54) DISPLAY DEVICE

(71) Applicant: Samsung Display Co., LTD., Yongin-si (KR)

(72) Inventors: Dong Hyun Kim, Seoul (KR); Gun Hee Kim, Seoul (KR); Sang Hoon Kim, Seoul (KR); Soo Hyun Moon, Yeonsu-gu (KR); Seung Chan Lee, Hwaseong-si (KR); Joo Hee Jeon, Hwaseong-si (KR); Sung Jin Hong, Seoul (KR); Tae Hoon Yang, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 175 days.

(21) Appl. No.: 16/888,108

(22) Filed: May 29, 2020

(65) Prior Publication Data

US 2020/0410921 A1 Dec. 31, 2020

(30) Foreign Application Priority Data

Jun. 26, 2019 (KR) ..... 10-2019-0076537

(51) Int. Cl.
*G09G 3/3225* (2016.01)
*G09G 3/20* (2006.01)

(52) U.S. Cl.
CPC ... *G09G 3/2092* (2013.01); *G09G 2300/0452* (2013.01); *G09G 2310/0267* (2013.01); *G09G 2310/0275* (2013.01)

(58) Field of Classification Search
CPC ..... G09G 3/2092; G09G 2300/0452; G09G 2310/0267; G09G 2310/0275; G09G 2300/0426; G09G 3/3233; G09G 2300/0819; G09G 2300/0842; G09G 2300/0861; G09G 2320/0214; G09G 2320/0223; G09G 2320/0238;
(Continued)

(56) References Cited

U.S. PATENT DOCUMENTS 9,864,400 B2 * 1/2018 Evans, V ..... H01L 27/14627
2006/0244693 A1 * 11/2006 Yamaguchi ..... G02F 1/13338 345/76

(Continued)

FOREIGN PATENT DOCUMENTS

KR 101223727 B1 1/2013
KR 1020150055375 A 5/2015

(Continued)

*Primary Examiner* — Jose R Soto Lopez
(74) *Attorney, Agent, or Firm* — Cantor Colburn LLP

(57) ABSTRACT

A display device: a substrate including a first display area and a second display area; a signal line which overlaps the first display area and the second display area; and a common electrode which overlaps the first display area and the second display area, where the first display area includes a first pixel area, the second display area includes a second pixel area and a transmitting area, the transmitting area includes a first transmitting area and a second transmitting area, which have different transmittances from each other, the common electrode overlaps the first pixel area, the second pixel area and the second transmitting area, and in the second transmitting area, at least a part of the signal line and the common electrode overlap each other.

18 Claims, 19 Drawing Sheets

(58) Field of Classification Search
CPC ..... G09G 2360/144; H01L 27/3276; H01L 27/156; H01L 27/3227; H01L 27/326; H01L 27/3218; H01L 27/3213; H01L 27/3216; H01L 51/5203; H01L 51/5262
See application file for complete search history.

(56) References Cited

U.S. PATENT DOCUMENTS

2008/0106628 A1* 5/2008 Cok ..... H04N 7/144 348/E5.022
2008/0165267 A1* 7/2008 Cok ..... H04N 7/144 348/E5.022
2011/0279689 A1* 11/2011 Maglaque ..... H04N 5/2253 348/333.01
2012/0105400 A1* 5/2012 Mathew ..... G06F 1/1605 345/207
2013/0135268 A1* 5/2013 Kanade ..... G09G 3/3611 345/207
2013/0135328 A1* 5/2013 Rappoport ..... G09G 3/3225 345/82
2013/0242479 A1* 9/2013 Yoo ..... H05K 5/0017 361/679.01
2014/0078104 A1* 3/2014 Lee ..... G06F 3/0445 345/174
2015/0144934 A1* 5/2015 Rappoport ..... G09G 3/3208 257/40
2016/0095210 A1* 3/2016 Heo ..... H05K 3/105 29/850
2016/0103359 A1* 4/2016 Kimura ..... G02F 1/133512 349/33
2016/0351645 A1* 12/2016 You ..... H01L 27/326
2017/0031323 A1* 2/2017 Kim ..... H01L 27/3246
2017/0123453 A1* 5/2017 Evans, V ..... G06F 3/041
2017/0123454 A1* 5/2017 Evans, V ..... G02F 1/133526
2017/0162111 A1* 6/2017 Kang ..... H01L 27/3276
2018/0005561 A1* 1/2018 Moon ..... G09G 3/3208
2018/0005574 A1* 1/2018 Kim ..... H01L 51/5234
2018/0107301 A1* 4/2018 Kimura ..... G06F 3/044
2018/0129328 A1* 5/2018 Park ..... G06F 1/3231
2018/0175117 A1* 6/2018 Lee ..... G06F 3/0443
2019/0123306 A1* 4/2019 Liang ..... G02B 3/0043
2019/0130822 A1* 5/2019 Jung ..... G09G 3/2003
2020/0059545 A1* 2/2020 Lee ..... H01L 27/3246
2020/0105844 A1* 4/2020 Wang ..... H01L 27/3272
2020/0135148 A1* 4/2020 Bai ..... H04M 1/0266

FOREIGN PATENT DOCUMENTS

KR 1020160037502 A 4/2016
KR 1020160071884 A 6/2016
KR 1020160139115 A 12/2016
KR 1020170113066 A 10/2017

* cited by examiner

DISPLAY DEVICE

This application claims priority to Korean Patent Application No. 10-2019-0076537, filed on Jun. 26, 2019, and all the benefits accruing therefrom under 35 U.S.C. § 119, the content of which in its entirety is herein incorporated by reference.

BACKGROUND

(1) Field

The disclosure relates to a display device.

(2) Description of the Related Art

A display device may include a display panel that includes pixels for displaying an image. The display device may further include a sensor that senses proximity of an object, ambient brightness, and the like, and the sensor may be located around the display panel. The display device may include a sensor disposed in a bezel area (an area surrounding the screen), and an object may be recognized by the sensor.

SUMMARY

Reducing the bezel area of a display device may increase the screen-to-body ratio of the display device, that is, the ratio of the screen to the front of the display device. The screen ratio reflects the level of technology of the display device, and simultaneously plays an important role in the consumer's choice of product. However, as it is difficult to dispose the sensor to the bezel area when reducing the bezel area of the display device, so it is desired to develop a technology for arranging and sensing of the sensor in a narrow area.

Exemplary embodiments have been made to increase transmittance of a display area corresponding to an optical member in a display having functions other than image displaying. In a part of the display area, transmittance with respect to light of a specific wavelength is increased to enhance sensing sensitivity of the optical member.

In an exemplary embodiment, a display device includes: a substrate including a first display area and a second display area; a signal line which overlaps the first display area and the second display area; and a common electrode which overlaps the first display area and the second display area, where the first display area includes a first pixel area, the second display area includes a second pixel area and a transmitting area, the transmitting area includes a first transmitting area and a second transmitting area, which have different transmittances from each other, the common electrode overlaps the first pixel area, the second pixel area and the second transmitting area, and in the second transmitting area, at least a part of the signal line and the common electrode overlap each other.

In an exemplary embodiment, the common electrode may include: a first area overlapping at least one of the first pixel area and the second pixel area; a second area overlapping the first transmitting area; and a third area disposed between the first area and the second area, and overlapping the second transmitting area.

In an exemplary embodiment, a thickness of a portion of the common electrode corresponding to the third area may be about 10% to about 90% of a thickness of a portion of the common electrode corresponding to the first area.

In an exemplary embodiment, the third area may surround edges of the first transmitting area.

In an exemplary embodiment, an opening may be defined through the common electrode to overlap the first transmitting area.

In an exemplary embodiment, the signal line may include a scan line and a light emission control line which extend along a first direction, and at least a part of the scan line and the light emission control line may overlap the third area.

In an exemplary embodiment, at least a part of the scan line and the light emission control line may alternately overlap the first area and the third area.

In an exemplary embodiment, the second pixel area and the transmitting area may be alternately arranged along the first direction, and at least a part of the scan line and the light emission control line may extend to overlap the second transmitting area while crossing the second pixel area.

In an exemplary embodiment, the signal line may include a data line and a driving voltage line which extend along a second direction different from the first direction, and, at least a part of the data line and the driving voltage line may overlap the third area.

In an exemplary embodiment, at least a part of the data line and the driving voltage line may alternately overlap the first area and the third area.

In an exemplary embodiment, the second pixel area and the transmitting area may be alternately arranged along the second direction, and at least a part of the data line and the driving voltage line may extend to overlap the second transmitting area, while crossing the second pixel area.

In an exemplary embodiment, each of the first pixel area and the second pixel area may include: a first pixel which displays a first color; a second pixel which displays a second color different from the first color; and a third pixel which displays a third color different from the first color and the second color.

In an exemplary embodiment, each of the first pixel area and the second pixel area may include: at least two first pixels; at least four second pixels; and at least two third pixels.

In an exemplary embodiment, at least two of the first pixel, the second pixel, and the third pixel may be different from each other in size.

In an exemplary embodiment, the common electrode overlapping the first display area may have a continuous shape.

In an exemplary embodiment, a plane size of the transmitting area and a plane size of the second pixel area may be substantially the same as each other.

In an exemplary embodiment, a display device includes: a substrate including a first display area and a second display area; a signal line which overlaps the first display area and the second display area; a common electrode which overlaps the first display area and the second display area; and an optical member that overlaps the second display area, where the first display area includes a first pixel area, the second display area includes a second pixel area and a transmitting area, the transmitting area includes a first transmitting area and a second transmitting area, which have different transmittances from each other, an opening is defined through the common electrode includes to overlap the first transmitting area, and the common electrode overlaps the second transmitting area, and at least a part of the signal line and the common electrode overlap in the second transmitting area.

According to exemplary embodiments, transmittance of the display area corresponding to the optical member may be increased in a display device having a function other than image display. In some display areas, sensitivity of the optical member may be improved by increasing transmittance for light at specific wavelengths.

BRIEF DESCRIPTION OF THE DRAWINGS

The above and other features of the invention will become more apparent by describing in more detail embodiments thereof with reference to the attached drawings, in which.

DETAILED DESCRIPTION

Figure 1:
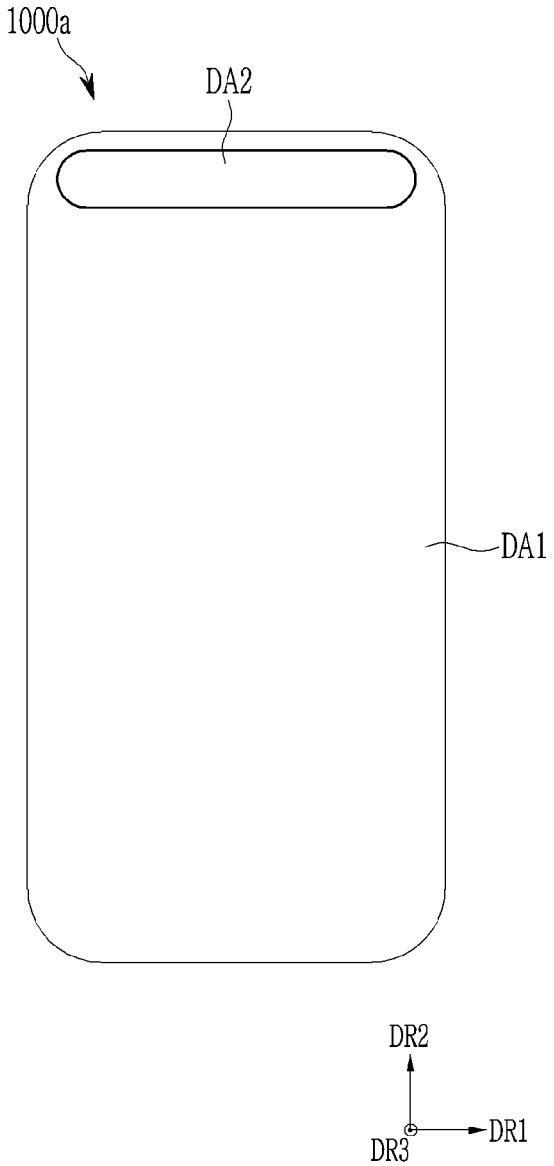
FIG. 1, FIG. 2, and FIG. 3 are schematic plan views that respectively show display areas of display devices according to exemplary embodiments.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

The drawings and description are to be regarded as illustrative in nature and not restrictive. Like reference numerals designate like elements throughout the specification.

In addition, the size and thickness of each configuration shown in the drawings are arbitrarily shown for better understanding and ease of description, but the present invention is not limited thereto. In the drawings, the thickness of layers, films, panels, regions, etc., are exaggerated for clarity. In addition, in the drawings, the thickness of some layers and regions is exaggerated for better understanding and ease of description.

It will be understood that when an element such as a layer, film, region, or substrate is referred to as being "on" another element, it can be directly on the other element or intervening elements may also be present. In contrast, when an element is referred to as being "directly on" another element, there are no intervening elements present. The word "on" or "above" means positioned on or below the object portion, and does not necessarily mean positioned on the upper side of the object portion based on a gravitational direction.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. As used herein, the phrase "at least one of" modifying listed items includes any and all combinations of one or more of the listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In addition, in this specification, the phrase "on a plane" means viewing a target portion from the top, and the phrase "on a cross-section" means viewing a cross-section formed by vertically cutting a target portion from the side.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Herein, "in a plan view (also referred to as on a plane)" implies a view of a plane that is parallel with two directions crossing each other (e.g., a first direction DR1 and a second direction DR2), and "in a cross-sectional view" implies a view of a plane cut along a direction (e.g., a third direction) that is perpendicular to a plane parallel with the first direction DR1 and the second direction DR2. In addition, when two constituent elements overlap each other, it implies that the two constituent elements overlap in the third direction DR3 (e.g., a direction perpendicular to a top surface of a substrate or a thickness direction of the substrate) unless otherwise stated.

Hereinafter, exemplary embodiments of the invention will be described in detail with reference to the accompanying drawings.

Hereinafter, an exemplary embodiment of a display device will be described in detail with reference to FIG. 1 to FIG. 4.

Figure 2:
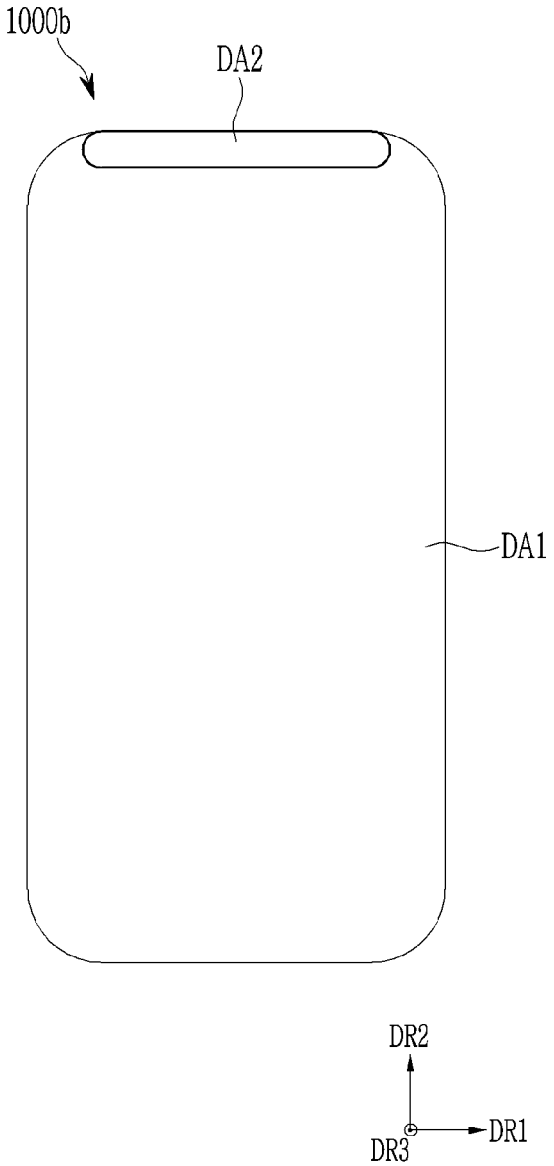
Figure 3:
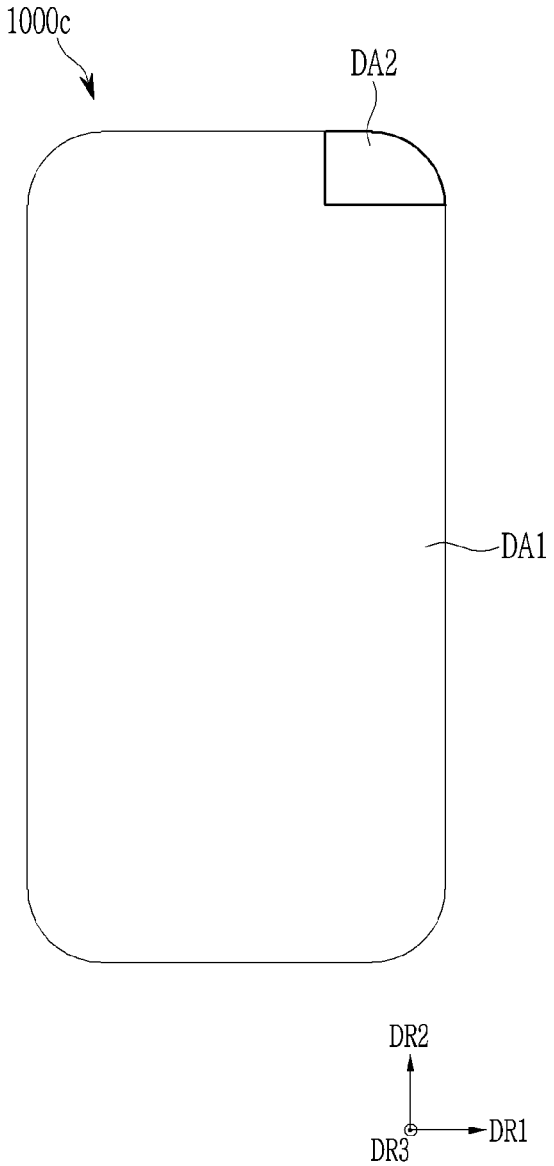
Figure 4:
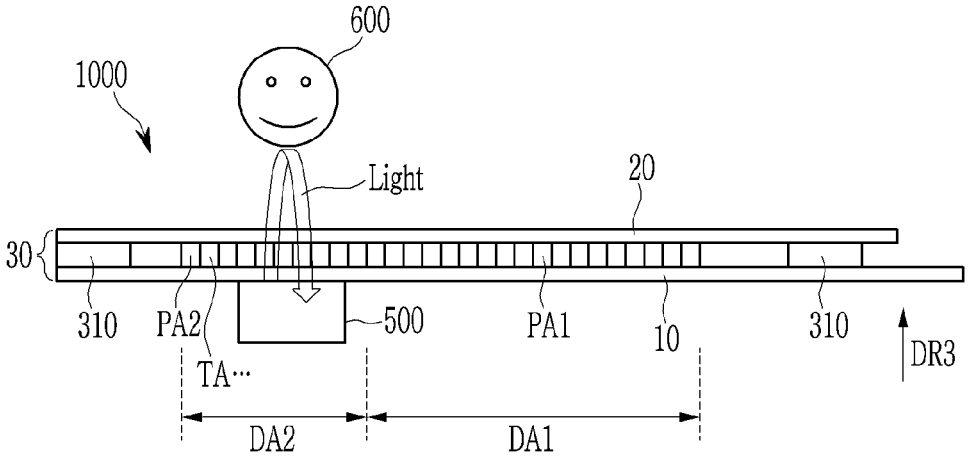
FIG. 4 is a schematic cross-sectional view of a display device according to an exemplary embodiment.

FIG. 1, FIG. 2, and FIG. 3 are plan views that show display areas of display devices respectively according to exemplary embodiments, and FIG. 4 is a schematic cross-sectional view of a display device according to an exemplary embodiment.

Referring to FIG. 1, an exemplary embodiment of a display device 1000*a* may include a first display area DA1, which is an area where an image is displayed, and a second display area DA2, which may display an image and have other functions.

The second display area DA2 may be surrounded by the first display area DA1, and may be disposed at a periphery of one side of the display device 1000*a* in a plan view. In a plan view, the first display area DA1 may be disposed between the second display area DA2 and edges of the display device 1000*a*. That is, with reference to the second direction DR2, at least one pixel rows included in the first display area DA1 may be disposed on a pixel row that is disposed at an outermost side of the second display area DA2.

In an exemplary embodiment, the second display area DA2 may be disposed at a periphery of an upper end of the display device 1000*a*, and may have a planar shape extending in a first direction DR1 along most of the upper edge of the display device 1000*a*.

In such an embodiment, an optical member may be disposed in the second display area DA2, and the optical member will be described hereinafter.

In an exemplary embodiment, the optical may include an infrared sensor. The infrared sensor may receive light of an infrared ray wavelength, and receive light reflected by an object. The display device calculates a distance between the display device and the object based on intensity of reflected light, and may not display an image if the distance is within a predetermined distance.

In an exemplary embodiment, the optical member may include an illuminance sensor. The illumination sensor may measure the illumination around the display device, and the display device may adjust brightness of a screen based on the measured illumination.

Alternatively, the display device may include an optical member having other various functions without being limited those described above.

In such an embodiment, light of a specific wavelength may be incident more on or emitted more from the second display area DA2 than the first display area DA1. In the second display area DA2, a ratio of an area where an image is displayed, that is, an area occupied by a pixel area, may be smaller than a ratio of an area occupied by a pixel area in the first display area DA1.

Resolution of the second display area DA2 may be lower than that of the first display area DA1. In such an embodiment, an average number of pixels (i.e., the number of the pixels in a unit area) included in the second display area DA2 may be smaller than an average number of pixels included in the first display area DA1. However, since the pixel area and the light transmitting area are regularly alternately arranged in the second display area DA2, the displayed image in the second display area DA2 may not be deteriorated.

Referring to FIG. 2, in an alternative exemplary embodiment, the second display area DA2 is substantially the same as that in the exemplary embodiment shown in FIG. 1, except that the first display area DA1 may not be positioned around at least one side of the second display area DA2. In a plan view, one edge of the second display area DA2 may match one edge of a display device 1000*b*. In one exemplary embodiment, for example, when the second display area DA2 is disposed at the periphery of an upper edge of the display device 1000*b*, the first display area DA1 may not be disposed above the second display area DA2. The outermost pixel row included in the second display area DA2 may be the outermost pixel row of a pixel area, which corresponds to the combination of the first display area DA1 and the second display area DA2 with reference to a second direction DR2.

Referring to FIG. 3, in another alternative exemplary embodiment, a second display area DA2 is substantially the same as the exemplary embodiment shown in FIG. 2, except that the second display area DA2 is disposed adjacent to a corner edge of a display device 1000*c* or at a periphery of the corner edge of the display device 1000*c*. In a plan view, one edge of the second display area DA2 may match one corner edge of the display device 1000*c*. In one exemplary embodiment, for example, where the second display area DA2 is disposed at the periphery of an upper corner of the display device 1000*c*, one edge of the second display area DA2 may match one corner edge at an upper side of the display device 1000*c*.

In such embodiments, the second display area DA2 may be located at various positions in the display area of the display device and may have various flat shapes. In another alternative exemplary embodiment, although not illustrated, the second display area DA2 may have a circular planar shape located at the periphery of the upper edge of the display device.

Referring to FIG. 4, an exemplary embodiment of a display panel 30 included in a display device 1000 may include a substrate 10 and an encapsulation substrate 20, which are disposed between in the above-described first display area DA1 and second display area DA2. The substrate 10 may be continuously formed in the first display area DA1 and the second display area DA2, and no removed portion may exist. A sealant 310 may be further disposed between the substrate 10 and the encapsulation substrate 20 at an edge of the display panel 30.

A plurality of first pixel areas PA1 may be disposed in the first display area DA1. A plurality of second pixel areas PA2 and a plurality of transmitting areas TA may be disposed in the second display area DA2. The first pixel area PA1, the second pixel area PA2, and the transmitting area TA will be described later in greater detail with reference to FIG. 5.

In an exemplary embodiment, the display device 1000 may include the display panel 30 and an optical member 500 disposed behind the display panel 30, and light of a wavelength used by the optical member 500 may pass through the second display area DA2 with higher transmittance than in the above-described first display area DA1. The optical member 500 may be include a camera, a flash, a sensor, or the like.

The optical member 500 emits light in a predetermined wavelength range toward an object 600 disposed near the display panel 30, or may receive light reflected from the object 600. Light of such a predetermined wavelength may be light at a wavelength that can be processed by the optical member 500, and may be light at wavelengths other than a visible light region, which is the light of the image displayed by the pixel PX. The light of the predetermined wavelength may pass the transmitting area TA disposed in the second display area DA2. In an exemplary embodiment, where the optical member 500 is an infrared camera, the light of the predetermined wavelength may be light of about 900 nanometers (nm) to about 1000 nm which is an infrared wavelength.

The optical member 500 may be disposed corresponding to the entire portion of the second display area DA2 in a plan view, or may be disposed corresponding to only a part of the second display area DA2. In one exemplary embodiment, for example, the optical member 500 may be disposed corresponding to a part of the second display area DA2 as shown in FIG. 4.

Hereinafter, a first display area DA1 and a second display area DA2 of a display device according to an exemplary embodiment will be described in detail with reference to FIG. 5 to FIG. 9, together with the above-described drawings.

Figure 5:
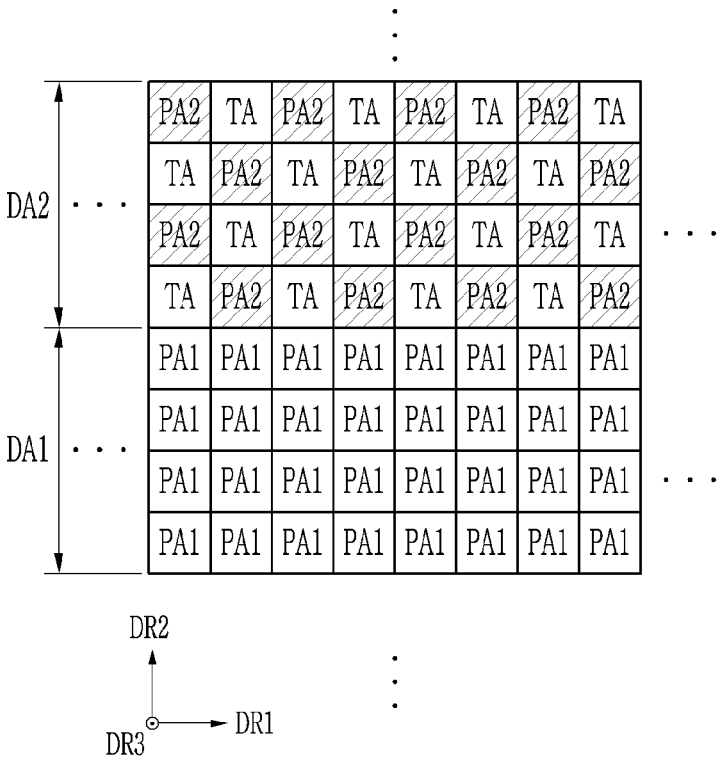
FIG. 5 schematically shows a first display area and a second display area according to the exemplary embodiment.
Figure 6:
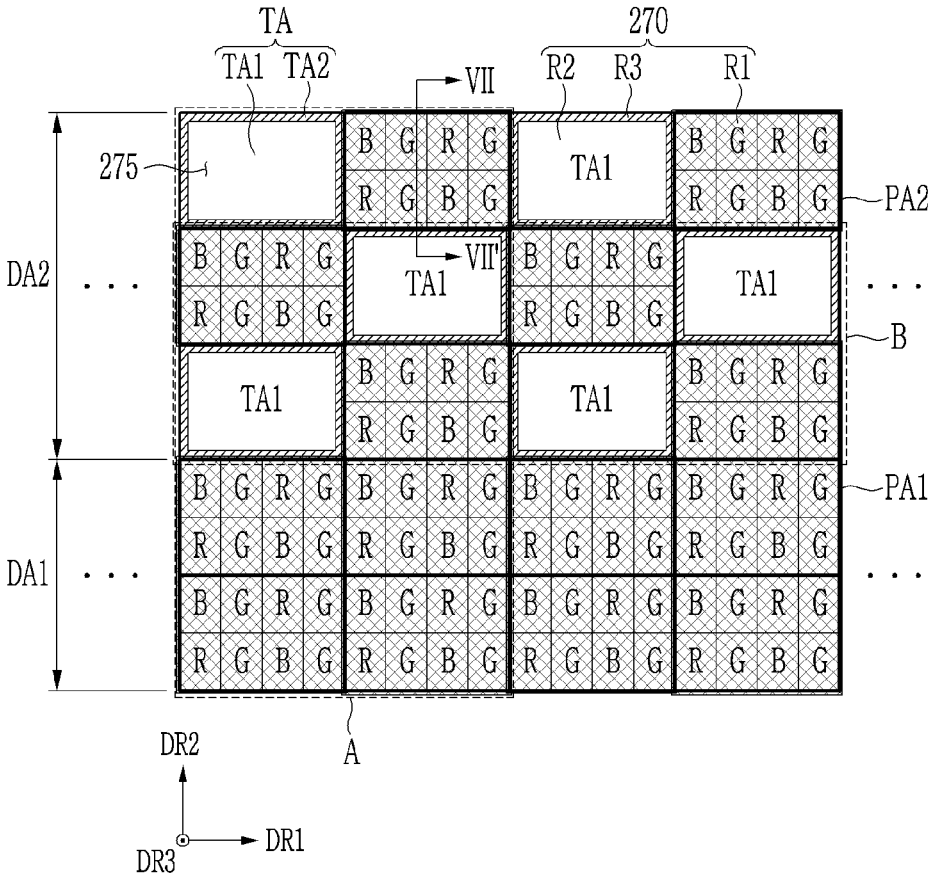
FIG. 6 schematically shows a first pixel area, a second pixel area, and a transmitting area.
Figure 7:
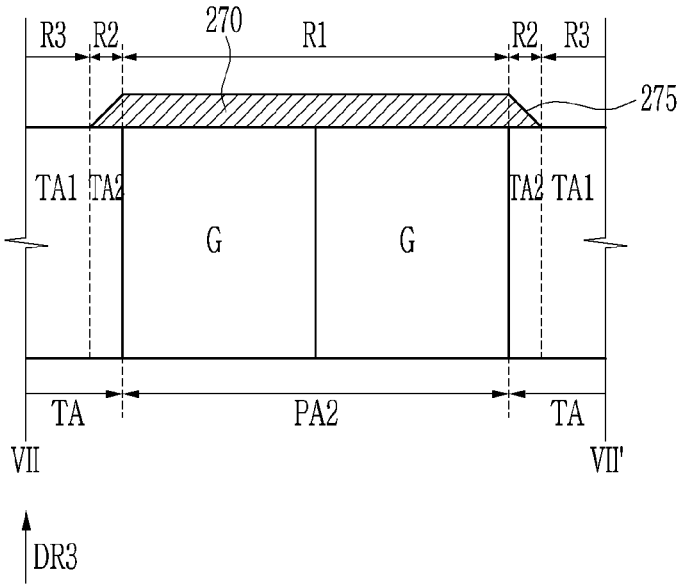
FIG. 7 is a cross-sectional view of FIG. 6, taken along line VII-VII'.
Figure 8:
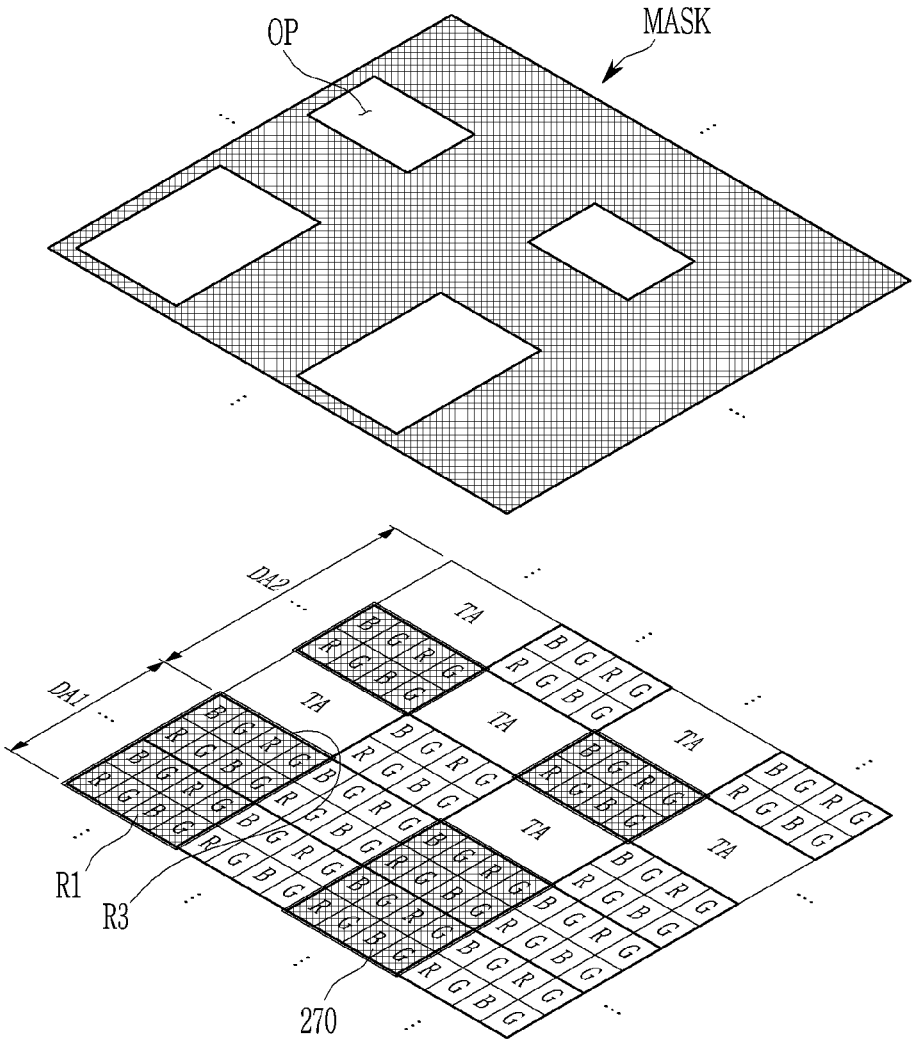
FIG. 8 and FIG. 9 schematically show a method of manufacturing a common electrode according to an exemplary embodiment.
Figure 9:
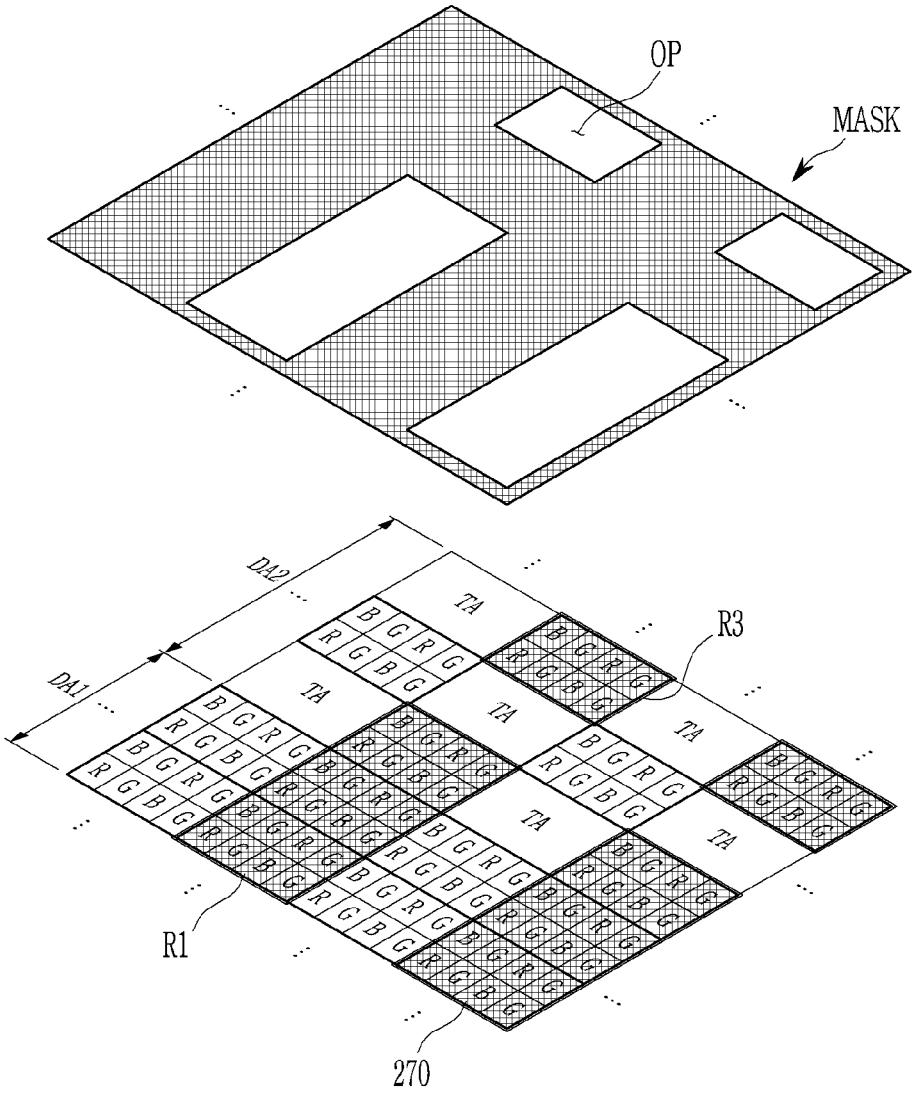

FIG. 5 schematically illustrates a first display area and a second display area according to an exemplary embodiment, FIG. 6 schematically illustrates the first pixel area, the second pixel area, and a transmitting area, FIG. 7 is a cross-sectional view of FIG. 6, taken along line VII-VII', and FIG. 8 and FIG. 9 schematically illustrate a method of manufacturing a common electrode according to an exemplary embodiment.

In an exemplary embodiment, referring to FIG. 5, a first display area DA1 includes a plurality of first pixel areas PA1, and a second display area DA2 includes a plurality of second pixel areas PA2 and a plurality of transmitting areas TA. One first pixel area PA1 and one second pixel area PA2 may have a same size as each other or may have different sizes from each other.

The second display area DA2 may include the second pixel area PA2 and the transmitting area TA, and the transmitting area TA may have higher transmittance with respect to light of a specific wavelength (e.g., light of an infrared ray wavelength) than the second pixel area PA2. No pixel is disposed in the transmitting area TA such that light of an image to be displayed may not be displayed or emitted from the transmitting area TA. Here, the pixel may be a unit area where light of an image is emitted.

The plurality of first pixel areas PA1 in the first display area DA1 may be arranged in a matrix form along a first direction DR1 and a second direction DR2, which are different from each other. In the second display area DA2, the plurality of second pixel areas PA2 and the plurality of transmitting areas TA may be arranged in a matrix form. In an exemplary embodiment, for uniform distribution of the second pixel areas PA2 and the transmitting areas TA, the second pixel areas PA2 and the transmitting areas TA may be arranged in a checkerboard pattern. In such an embodiment, transmitting areas TA are adjacent to each other in the first direction DR1 and the second direction DR2 at the periphery of one second pixel area PA2, and second pixel areas PA2 may be adjacent to each other in the first direction DR1 and the second direction DR2 at the periphery of one transmitting area TA. One second pixel area PA2 and one transmitting area TA may have a same size as each other or may have different sizes from each other. The transmitting areas TA may have a same size as each other or may have different sizes from each other. The arrangement and the size of the second pixel area PA2 and the transmitting area TA may be modified in various ways.

In the second display area DA2, the light transmitting area TA and the second pixel area PA2 are arranged in a regular layout so that an image can be displayed as in the second display area DA2, and other functions such as infrared sensing and illumination sensing other than image display may be carried by using the above-described optical member.

In an exemplary embodiment, referring to FIG. 6 and FIG. 7, each of the first pixel area PA1 and the second pixel area PA2 may include a plurality of pixels R, G, and B. In an exemplary embodiment, the pixel has a configuration including a pixel circuit portion and a pixel light emission portion, and referring to a cross-section described with reference to FIG. 23, the pixel circuit unit may include a plurality of wire and conductive layers disposed between the substrate 110 and the pixel electrode 191*a*, and the pixel light emission portion may include a pixel electrode and an emission layer.

The first pixel area PA1 and the second pixel area PA2 may each include at least one of a first pixel R that displays a first color, a second pixel G that displays a second color, and a third pixel B that displays a third color. According to an exemplary embodiment, the first pixel area PA1 and second pixel area PA2 each may include a first pixel R, a second pixel G, and a third pixel B. In such an embodiment, the first pixel area PA1 and the second pixel area PA2 may each include at least two first pixels R, at least four second pixels G, and at least two third pixels B. Each transmitting area TA may have a size that corresponds to eight pixels, but not being limited thereto.

The plurality of pixels R, G, and B included in one pixel row of the pixel areas PA1 and PA2 may be iteratively arranged in the order of the third pixel B, the second pixel G, the first pixel R, and the second pixel G, or in the order of the first pixel R, the second pixel G, the third pixel B, and the second pixel G, along the first direction DR1. The invention is not limited thereto, and the layouts of the pixels R, G, and B included in one pixel row may be variously modified.

In an exemplary embodiment, each of the transmitting areas TA may include a first transmitting area TA1 and a second transmitting area TA2. The second transmitting area TA2 may have a shape surrounding the first transmitting area TA1 on a plane.

The first transmitting area TA1 and the second transmitting area TA2 may have different transmittances from each other with respect to light of a specific wavelength. In one exemplary embodiment, for example, light transmittance of the first transmitting area TA1 may be greater than that of the second transmitting area TA2. A common electrode 270 may not overlap the first transmitting area TA1 on a plane, and a part of the common electrode 270 and a part of a signal line may be disposed in the second transmitting area TA2, such that light transmittance of the first transmitting area TA1 is greater than that of the second transmitting area TA2. In such an embodiment where a part of the common electrode 270 and a part of a signal line may be disposed in the second transmitting area TA2, the second transmitting area TA2 may have greater transmittance than that of each of the first pixel area PA1 and the second pixel area PA2, and may substantially transmit some light.

In such an embodiment, the common electrode 270 may be disposed in the first display area DA1 and the second display area DA2 of the display device. A portion of the common electrode overlapping the first display area DA1 and a portion of the common electrode overlapping the second display area DA2 may be connected to define a single electrode or integrally formed as a single unitary unit, and thus may transmit a constant common voltage.

The common electrode 270 disposed in the first display area DA1 may be continuously formed as a single electrode without a cutout, an opening, a pattern, and the like.

A plurality of openings 275 is defined through the portion of the common electrode 270 disposed in the second display area DA2. In a plan view, the plurality of openings 275 may overlap a part of the transmitting areas TA, for example, the first transmitting area TA1.

In an exemplary embodiment, as shown in FIGS. 6 and 7, the common electrode 270 may include a first region R1 overlapping the first pixel area PA1 and the second pixel area PA2, a second region R2 overlapping the first transmitting area TA1, and a third region R3 disposed between the first region R1 and the second region R2, and overlapping the second transmitting area TA2. The second region R2 may be a region that overlaps the openings 275 defined in the common electrode 270. The third region R3 may be disposed along an edge of the first transmitting area TA1.

In the first region R1, the common electrode 270 may have a substantially constant predetermined thickness. The common electrode 270 in the second region R2 may have a shape that is partially removed, and the second regions R2 may overlap the openings 275 of the common electrodes 270. In the third regions R3, the common electrode 270 may have a thickness of about 10% to about 90% of the thickness thereof in the first region R1.

In an exemplary embodiment, the common electrode 270 may have a planar shape that substantially corresponds to the first region R1 and the third regions R3. In such an embodiment, the first region R1 and the third regions R3 may be connected with each other, and first regions R1 disposed in different rows or different columns may be connected with each other by the third regions R3.

In such an embodiment, the openings 275 overlapping the first transmitting areas TA1 are defined through the common electrode 270, and thus the common electrode 270 may have a shape that is partially removed in the first transmitting area TA1. Thus, transmittance with respect to light (e.g., light of an infrared ray wavelength) of a specific wavelength in the transmitting area TA may become greater than transmittance in the first pixel area PA1 and in the second pixel area PA2. Accordingly, light emitted from the optical member or incident on the optical member disposed at a rear side of the display panel transmits through the display panel with high transmittance in the transmitting areas TA, and accordingly, a recognition rate, sensing accuracy, etc. of the object to be recognized by the optical member may be increased.

In such an embodiment, the common electrode 270 may be partially removed in an area overlapping the second display area DA2, and thus may have an area that is reduced to the area of the common electrode 270 that overlaps the entire second display area DA2. Accordingly, a signal delay due to resistance-capacitance ("RC") delay may be reduced.

Next, an exemplary embodiment of a method for manufacturing the common electrode 270 described above with reference to FIG. 6 and FIG. 7 will be described in detail with reference to FIG. 8 and FIG. 9.

In an exemplary embodiment, as shown in FIG. 8, a part of the common electrode 270 is deposited on a substrate by using a mask MASK. In such an embodiment, a plurality of openings OP is defined in the mask MASK, and parts of the common electrode 270 are formed in areas corresponding to the openings OP.

In such an embodiment, the first regions R1 of the common electrode 270 may be formed in the areas corresponding to the openings OP, and the third region R3 of the common electrode 270 may be formed along edges of each opening OP.

Next, as shown in FIG. 9, the same mask MASK is moved a predetermined distance in the first direction DR1 and a predetermined distance in the second direction DR2 to deposit a portion of the common electrode 270 on the substrate again.

In such an embodiment, as described above with reference to FIG. 8, a first region R1 of the common electrode 270 may be formed in a region corresponding to the opening OP, and a third region R3 of the common electrode 270 may be formed along an edge of the opening OP.

The common electrode 270 described above with reference to FIG. 7 may be formed by repeating such a process a plurality of times. In such a process, the first region R1 of the common electrode 270 is formed in the region overlapping the opening OP of the mask MASK, the second region R2 of the common electrode 270 is formed in the region not overlapping the opening OP, and the third region R3 may be formed in between the first region R1 and the second region R2. The third region R3 may be an edge region surrounding the opening OP, and may be a shadow region having a thickness of about 10% to 90% of the thickness of the common electrode 270 formed in the first region R1.

According to an exemplary embodiment, adjacent third regions R3 may overlap each other. Therefore, first regions R1 located in different rows or columns may also be connected to each other by the third region R3, and may receive a same voltage as each other.

Figure 10:
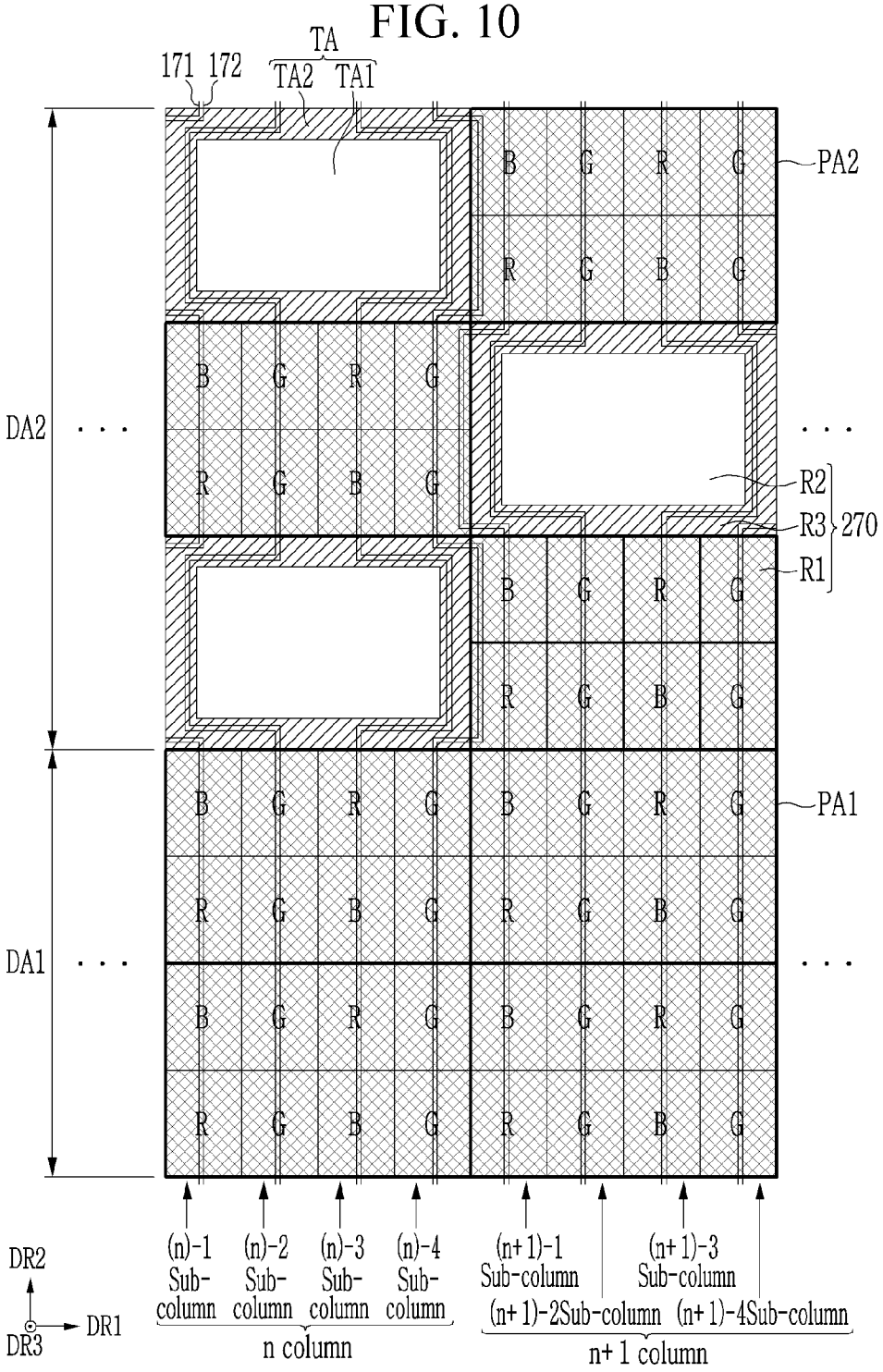
FIG. 10 schematically shows a data line and a driving voltage line disposed in a display area according to an exemplary embodiment.

Next, referring to FIG. 10, an exemplary embodiment of a display device will be described. FIG. 10 schematically shows a data line and a driving voltage line disposed in a display area according to an exemplary embodiment.

Referring to FIG. 10, an exemplary embodiment of a display device may include a plurality of transmitting areas TA, a second pixel area PA2, and a first pixel area PA1, which form one column. In one exemplary embodiment, for example, a transmitting area TA, a second pixel area PA, a transmitting area TA, and a plurality of pixel areas PA1 may be sequentially arranged in an n-th column located in the left side in FIG. 10. In such an embodiment, a second pixel area PA2, a transmitting area TA, a second pixel area PA2, and a plurality of first pixel areas PA1 may be sequentially arranged in an (n+1)-th column located in the right side in FIG. 10.

Each of the pixels R, G, and B included in the first pixel area PA1 and the second pixel area PA2 may be connected with a data line 171 and a driving voltage line 172 extending substantially in a second direction DR2. In such an embodiment, at least a part of the data line 171 and at least a part of the driving voltage line 172 passing through the second transmitting area TA2 may overlap the third region R3 included in the common electrode 270.

In an exemplary embodiment, a plurality of data lines 171 and a plurality of driving voltage lines 172 connected with the first pixel area PA1 and the second pixel area PA2 included in the n-th column will now be described. The plurality of second pixel areas PA2 and the plurality of first pixel areas PA1 disposed in the n-th column may include a plurality of pixels R, G, and B that form an (n)-1 sub-column, an (n)-2 sub-column, an (n)-3 sub-column, and an (n)-4 sub-column. Herein, the (n)-1 sub-column, the (n)-2 sub-column, the (n)-3 sub-column, and the (n)-4 sub-column may mean first to fourth sub-columns of the (n)-th column, respectively.

In the (n)-1 sub-column, the data line 171 and the driving voltage line 172 extend while making a detour along a second transmitting area T2 disposed at the left edge of the transmitting area TA and overlapping a second pixel area TA2 in the left side (not shown in the drawing), and then may be sequentially connected with a third pixel B and a first pixel R. In the (n)-1 sub-column, the data line 171 and the driving voltage line 172 may further pass through the second pixel area PA2 (not shown) disposed at the left edge of the transmitting area TA, and then may be alternately connected with a plurality of third pixels B and a plurality of first pixels R included in the first pixel area PA1.

In the (n)-2 sub-column, the data line 171 and the driving voltage line 172 make a detour along the second transmitting area TA2 located at the left edge of the transmitting area TA and are then connected with two second pixels G, and then may make a detour along the second transmitting area TA2 located at the left edge of the transmitting area TA. The data line 171 and the driving voltage line 172 may further extend to be connected to a plurality of second pixels G located in the (n)-2 sub-column in the first pixel area PA1.

In the (n)-3 sub-column, the data line 171 and the driving voltage line 172 make a detour along a second transmitting area TA2 located at the right edge of the transmitting area TA and are then connected with the first pixel R and the third pixel B, and then may make a detour again along the second transmitting area TA2 located at the right edge of the transmitting area TA. The data line 171 and the driving voltage line 172 may further extend to be alternately connected with a plurality of first pixels R and a plurality of third pixels B located in the (n)-3 sub-column.

In the (n)-4 sub-column, the data line 171 and the driving voltage line 172 extend while overlapping the second pixel area PA located at the right side while making a detour along the second transmitting area TA2 located at the right edge among the transmitting area TA, and then pass the second pixels G and make a detour along the second transmitting area TA2 located at the right edge among the transmitting area TA and the second pixel area PA2 located at the right side. The data line 171 and the driving voltage line 172 may further extend to be connected with a plurality of second pixels G located in the (n)-4 sub-column in the first pixel area PA1.

In the plurality of second pixel area PA2 located in the n-th column, a plurality of pixels R, G, and B included in the second pixel area PA2 may be connected with a plurality of data lines 171 and a plurality of driving voltage lines 172. In such an embodiment, at least a part of the plurality of data lines 171 may make a detour to overlap the left area of the second transmitting area TA2, and other part of the plurality of data lines 171 may make a detour to overlap the right area of the second transmitting area TA2. The other part of the plurality of data lines 171 may overlap another second pixel area PA2 that is adjacent thereto.

Similarly, at least a part of the plurality of driving voltage lines 172 may make a detour to be overlapped with the left area of the second transmitting area TA2, and the other part of the plurality of driving voltage lines 172 may make a detour to overlap the right area of the second transmitting area TA2. In such an embodiment, the other part of the plurality of driving voltage lines 172 may overlap another second pixel area PA2 adjacent thereto.

The data line 171 and the driving voltage line 172 that make a detour while overlapping the second transmitting area TA2 may overlap a third area R3. In such an embodiment, the data line 171 and the driving voltage line 172 overlapping the second display area PA1 may overlap a first area R1 of the common electrode 270 when detouring. The detouring data line 171 and driving voltage line 172 may overlap any one of the second transmitting area TA2 and the second display area PA2.

Next, a plurality of data lines 171 and a driving voltage line 172 included in an (n+1)-th column will be described. A plurality of second pixel areas PA2 and a plurality of first pixel areas PA1 located in the (n+1)-th column may include a plurality of pixels R, G, and B corresponding to an (n+1)-1 sub-column, an (n+1)-2 sub-column, an (n+1)-3 sub-column, and an (n+1)-4 sub-column. Here, the (n+1)-1 sub-column, the (n+1)-2 sub-column, the (n+1)-3 sub-column, and the (n+1)-4 sub-column may mean first to fourth sub-columns of the (n+1)-th column.

In the (n+1)-1 sub-column, the data line 171 and the driving voltage line 172 may be connected with third pixels B and first pixels R located in the (n+1)-1 sub-column, and then may be connected again with the third pixels B and the first pixels R after passing through a second display area PA2 that is adjacent to the second transmitting area TA2. The data line 171 and the driving voltage line 172 may further extend to be alternately connected with the plurality of third pixels B and the plurality of first pixels R located in the (n+1)-1 sub-column in the first pixel area PA1.

In the (n+1)-2 sub-column, the data line 171 and the driving voltage line 172 may be connected with two second pixels G, and then may be connected again with two second pixels G after making a detour to overlap with the second transmitting area TA2 in the left area of the transmitting area TA. The data line 171 and the driving voltage line 172 may further extend to be connected with a plurality of second pixels G located in the (n+1)-2 sub-column in the first pixel area PA1.

In the (n+1)-3 sub-column, the data line 171 and the driving voltage line 172 pass through the first pixel R and the third pixel B, and then may be connected with the first pixels R and the third pixels B after making a detour to overlap the right area of the second transmitting area TA2. The data line 171 and the driving voltage line 172 may further extend to be alternately connected with the plurality of first pixels R and the plurality of third pixels B located in the (n+1)-3 sub-column of the first pixel area PA1.

Next, in the (n+1)-4 sub-column, the data line 171 and the driving voltage line 172 make a detour to overlap a second display area PA2 (not shown) in the right side of the second transmitting area TA1 after passing through the second pixels G, and then may be connected again with the second pixels G. The data line 171 and the driving voltage line 172 may further extend to be connected with the plurality of second pixels G located in the (n+1)-4 sub-column of the first pixel area PA1.

In the second pixel area PA2 located in the columns, the plurality of pixels R, G, and B included in the second pixel area PA2 may be connected with the plurality of data lines 171 and the plurality of driving voltage lines 172. In such an embodiment, at least a part of the plurality of data lines 171 may make a detour to overlap the left area of the second transmitting area TA2, and another part of the plurality of data lines 171 may make a detour to overlap the right area of the second transmitting area TA2. In such an embodiment, a part of the rest of the plurality of data lines 171 may make a detour to overlap a second display area PA2 that is adjacent thereto.

In an exemplary embodiment, at least a part of the plurality of driving voltage lines 172 may make a detour to overlap with the left area of the second transmitting area TA2, and another part of the plurality of driving voltage lines 172 may make a detour to overlap the right area of the second transmitting area TA2. In such an embodiment, a part of the rest of the plurality of driving voltage lines 172 may make a detour to overlap a second display area PA2 that is adjacent thereto.

The data line 171 and the driving voltage line 172 making a detour along the second transmitting area TA2 may overlap the third area R3 of the common electrode 270. In such an embodiment, the data line 171 and the driving voltage line 172 making a detour along the second display area PA2 may overlap the first area R1 of the common electrode R1. That is, the data line 171 and the driving voltage line 172, which make a detour, may overlap any one of the second transmitting area TA2 and the second display area PA2.

The data line 171 and the driving voltage line 172 connected with the plurality of pixels R, G, and B may overlap the first area R1 and/or the third area R3 of the common electrode 270. Specifically, the data line 171 and the driving voltage line 172 overlapping the first pixel area PA1 and the second pixel area PA2 may overlap the first area R1 of the common electrode 270. The data line 171 and the driving voltage line 172 overlapping the second transmitting area TA2 may overlap the third area R3 of the common electrode 270. In such an embodiment, the data line 171 and the driving voltage line 172, which make a detour along the edge of the first transmitting area TA1, may overlap the third area R3 of the common electrode 270. The data line 171 and the driving voltage line 172 overlapping the second transmitting area TA2 may alternately overlap the first area R1 and the third area R3 of the common electrode 270. Accordingly, an area occupied by signal lines in the transmitting area TA may be reduced, thereby increasing light transmittance of the transmitting area where the optical member is located.

Figure 11:
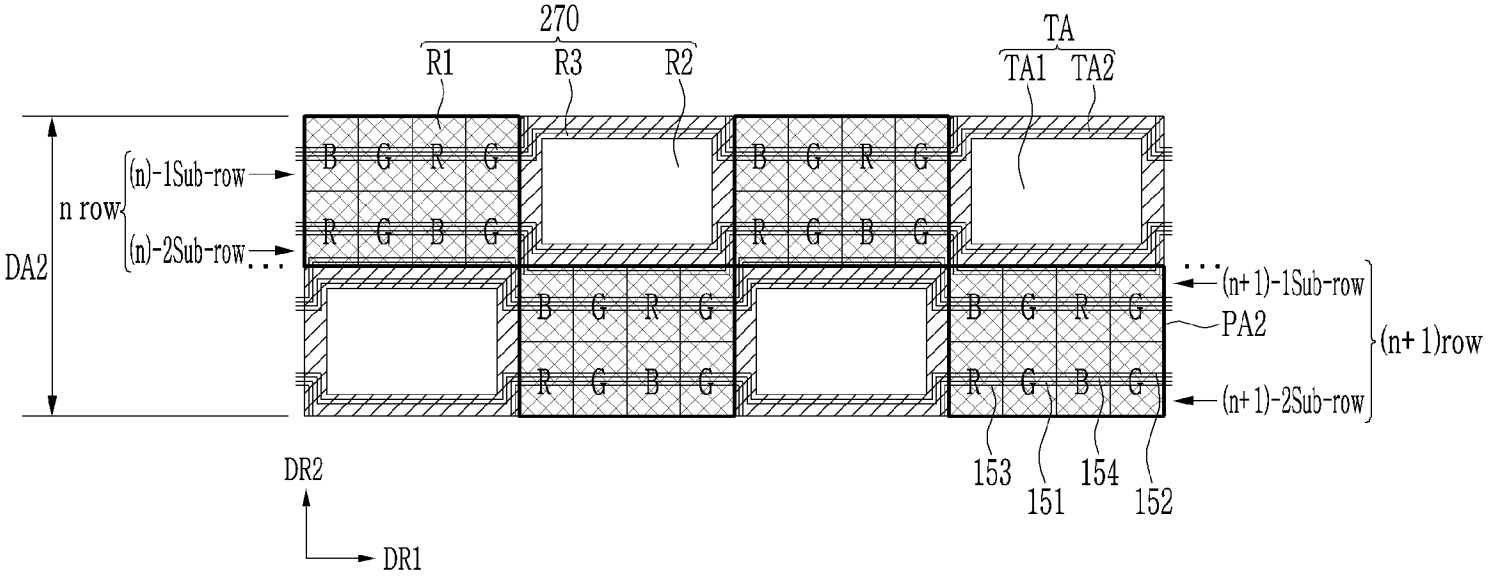
FIG. 11 schematically shows a scan line and a light emission control line that are located in the display area according to the exemplary embodiment.

Next, an exemplary embodiment of the display device will be described. FIG. 11 schematically shows a scan line and a light emission control line that are located in the display area according to an exemplary embodiment.

In a second pixel area PA2 and a transmitting area PA corresponding to an n-th row, the second pixel area PA2 and the transmitting area TA may be alternately disposed along a first direction DR1 from the left side. In an (n+1)-th row, the second pixel area PA2 and the transmitting area TA may be alternately disposed along the first direction DR1 from the left side.

The second pixel area PA2 located in the n-th row may, for example, include a plurality of pixels R, G, and B, which are arranged in two rows. A plurality of pixels R, G, and B located in an (n)-1 sub-row may be a third pixel B, a second pixel G, a first pixel R, and a second pixel G along the first direction DR1. Here, the (n)-1 sub-row and the (n)-2 sub-row may mean first and second sub-rows of the n-th row, respectively. A plurality of pixels R, G, and B located in an (n)-2 sub-row may be a first pixel R, a second pixel G, a third pixel B, and a second pixel G along the first direction DR1. However, the arrangement of the pixels R, G and B is not limited thereto, and may be variously modified.

The second pixel area PA2 may include a plurality of signal lines extending along the first direction DR1. In one exemplary embodiment, for example, the plurality of signal lines may include a plurality of scan lines 151, 152, and 154 and a light emission control line 153 extending along the first direction DR1.

In the second pixel area PA2 located in the n-th row, at least a part of the plurality of scan lines 152, 153, and 154 and the light emission control line 153 connected with the plurality of pixels B, G, R, and G located in the (n)-1 sub-row may make a detour along an upper area of the second transmitting area TA2 and then be connected again with the plurality of pixels B, G, R, and G included in the second pixel area PA2. In the second pixel area PA2 located in the n-th row, a part of the rest of the plurality of scan lines 152, 153, and 154 and the light emission control line 153 connected with the plurality of pixels B, G, R, and G located in the (n)-1 sub-row may make a detour along a second display area PA2 (not shown) located above the second transmitting area TA2, and then may be connected again with the plurality of pixels B, G, R, and G included in the second pixel area PA2.

In the second pixel area PA2 located in the n-th row, at least a part of the plurality of scan lines 152, 153, and 154 and the light emission control line 153 connected with the plurality of pixels R, G, B, and G located in the (n)-2 sub-row may make a detour along a lower area of the second transmitting area TA2 and then be connected again with the plurality of pixels B, G, R, and G included in the second pixel area PA2. In the second pixel area PA2 located in the n-th row, a part of the rest of the plurality of scan lines 152, 153, and 154 and the light emission control line 153 connected with the plurality of pixels R, G, B, and G located in the (n)-2 sub-row may make a detour along a second display area PA2 disposed below the second transmitting area TA2 and then be connected again with the plurality of pixels B, G, R, and G included in the second pixel area PA2.

At least a part of the plurality of scan lines 151, 152, and 154 and the light emission control line 153 connected with a plurality of pixels B, G, R, and G located in an (n+1)-1 sub-row may make a detour along the second transmitting area TA2 and an upper side second display area PA2 and then be connected with the plurality of pixels B, G, R, and G included in the second pixel area PA2, and then make a detour again along the second transmitting area TA2 and the upper second display area PA2. A part of the rest of the plurality of scan lines 151, 152, and 154 and the light emission control line 153 connected with the plurality of pixels B, G, R, and G may be connected with the plurality of pixels B, G, R, and G included in the second pixel area PA2 by making a detour along the second transmitting area TA2, and then make a detour again along the second transmitting area TA2. At least a part of the plurality of scan lines 151, 152, and 154 and the light emission control line 153 connected with a plurality of pixels R, G, B, and G disposed in an (n+1)-2 sub-row may be connected with the plurality of pixels R, G, B, and G included in the second pixel area PA2 by making a detour along a lower area of the second transmitting area TA2, and then may make a detour along the lower area of the second transmitting area TA2. Here, the (n+1)-1 sub-row and the (n+1)-2 sub-row may mean first and second sub-rows of the (n+1)-th row. A part of the rest of the plurality of scan lines 151, 152, and 154 and the light emission control line 153 connected with the plurality of pixels R, G, B, and G disposed in an (n+1)-2 sub-row may be connected with the plurality of pixels R, G, B, and G included in the second pixel area PA2 by making a detour along a second display area PA2 (not shown) disposed below the second transmitting area TA2, and then may make a detour along the second transmitting area TA2 and a second display area PA2 (not shown) disposed in a lower side.

The plurality of scan lines 151, 152, and 154 and the light emission control line 153 extending along the first direction DR1 may cross the second pixel area PA2, and may overlap the first area R of the common electrode 270 overlapping the second pixel area PA2. In such an embodiment, at least a part of the plurality of scan lines 151, 152, and 154 and the light emission control line 153 may overlap the third area R3 of the common electrode 270. At least a part of the plurality of scan lines 151, 152, and 154 and the light emission control line 153 may alternately overlap the first area R1 and the third area R3 of the common electrode 270. Such a shape may allow the first transmitting area TA1 having relatively high transmittance to be increased or maximized, thereby providing a transmitting area TA having improved light transmittance.

Hereinafter, the above-stated exemplary embodiment will be described in greater detail with reference to FIG. 12 to FIG. 14.

Figure 12:
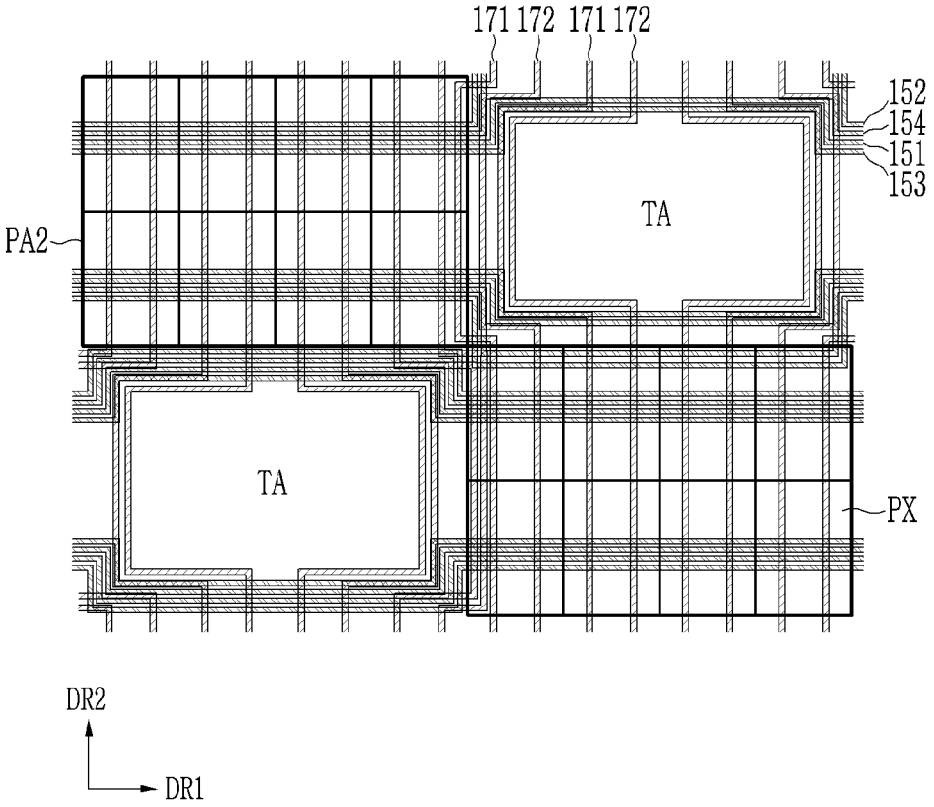
FIG. 12 schematically shows a plurality of second pixel areas corresponding to an n-th row and a plurality of second pixel areas corresponding to an (n+1)-th row.
Figure 13:
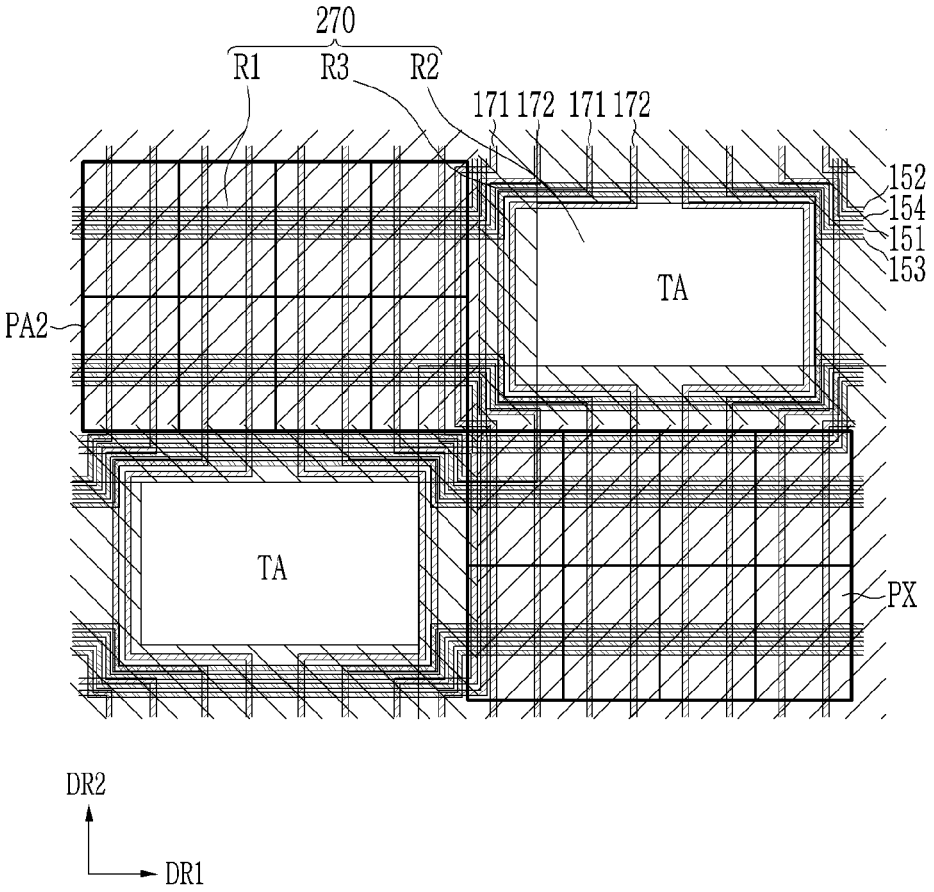
FIG. 13 schematically shows a common electrode combined the exemplary embodiment of FIG. 12.
Figure 14:
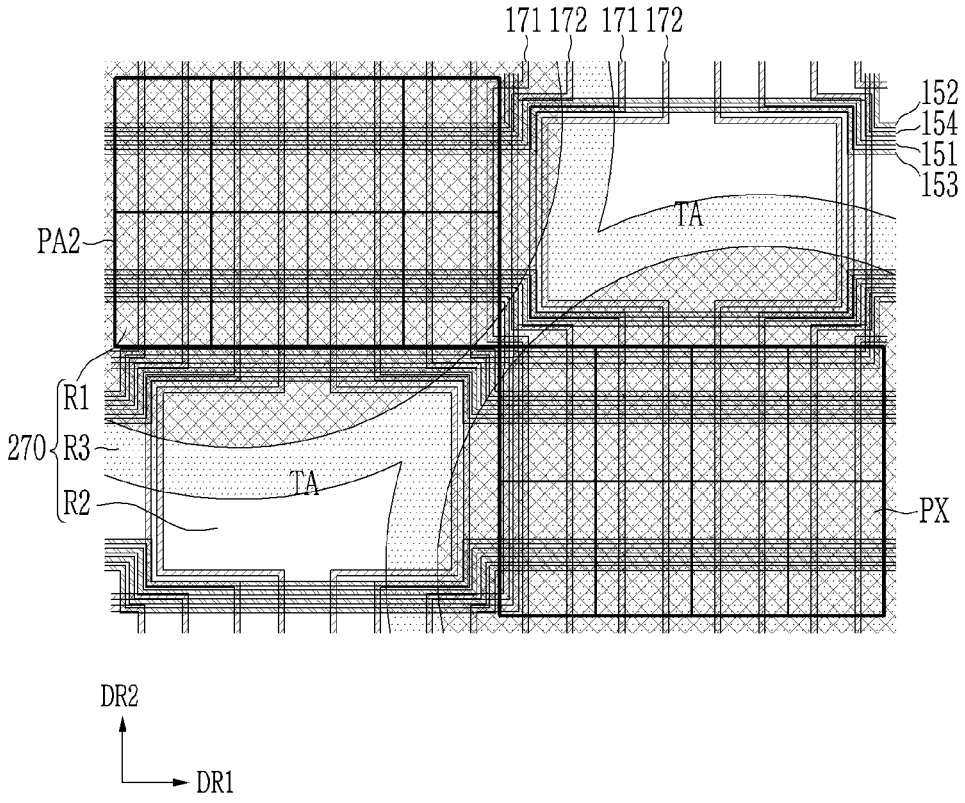
FIG. 14 shows an exemplary modification of FIG. 13.

FIG. 12 schematically shows a plurality of second pixel areas PA2 corresponding to the n-th row and a plurality of second pixel areas PA2 corresponding to the (n+1)-th row, FIG. 13 schematically show the common electrode of the exemplary embodiment of FIG. 12, and FIG. 14 shows an exemplary modification of FIG. 13.

First, referring to FIG. 12, two second pixel areas PA2 and two transmitting areas TA may be arranged in a checkerboard format. In the n-th row, the second pixel area PA2 and the transmitting area TA may be arranged in such an order, and in the (n+1)-th row, the transmitting area TA and the second pixel area PA2 may be arranged in such an order.

In an exemplary embodiment, each second pixel area PA2 may include, for example, eight pixels PX. In such an embodiment, each pixel PX may include a plurality of data lines 171 and a plurality of driving voltage lines 172 extending along a second direction DR2.

A data line 171 and a driving voltage line 172 connected to four pixels PX that are disposed relatively in the left side among the eight pixels arranged in the n-row and n-column may extend along a left-side area of the second transmitting area TA2 disposed in the n-th column and (n+1)-th row. In such an embodiment, at least a part of the data line 171 and the driving voltage line 172 may extend while overlapping the transmitting area TA, and a part of the rest of the data line 171 and the driving voltage line 172 may extend while overlapping the second transmitting area TA2 and an adjacent second display area PA2 (not shown).

A data line 171 and a driving voltage line 172 connected to four pixels PX that are disposed relatively in the right side among the eight pixels arranged in the n-row and n-column may make a detour along a right-side area of the second transmitting area TA2 disposed in the n-th column and (n+1)-th row. In such an embodiment, at least a part of the data line 171 and the driving voltage line 172 may extend while overlapping the transmitting area TA, and a part of the rest of the data line 171 and the driving voltage line 172 may extend while overlapping the transmitting area TA and an adjacent second display area PA2.

A data line extending along the left edge of the transmitting area TA and/or the second display area PA2 in the n-th row and (n+1)-th column may be connected with two pixels PX disposed relatively in the left side among right pixels disposed in the (n+1)-th row and (n+1)-th column. A driving voltage line 172 extending along the left edge of the transmitting area TA and/or the second display area PA2 in the n-th row and (n+1)-th column may be connected with two pixels PX disposed relatively in the left side among the eight pixels disposed in the (n+1)-th row and (n+1)-th column.

In an exemplary embodiment, at least a part of scan lines 151, 152, and 154 and a light emission control line 153 connected with four pixels PX disposed relatively in an upper side among the eight pixels in the n-th row and n-th column may extend along an upper area of the second transmitting area PA2 disposed in the n-th row and (n+1)-th column. A part of the rest of the scan lines 151, 152, and 154 and the light emission control line 153 connected with the four pixels PX disposed relatively in the upper side among the eight pixels in the n-th row and n-th column may extend along the transmitting area TA disposed in the n-th row and (n+1)-th column and a second display area PA2 (not shown) disposed thereabove.

At least a part of scan lines 151, 152, and 154 and a light emission control line 153 connected with four pixels PX disposed relatively in a lower side among the eight pixels arranged in the n-th row and n-th column may extend along a lower side area of the transmitting area TA disposed in the n-th row and (n+1)-th column. In such an embodiment, a part of the rest of the scan lines 151, 152, and 154 and the light emission control line 153 connected with the four pixels PX disposed relatively in the lower side among the eight pixels disposed in the n-th row and n-th column may extend along the transmitting area TA disposed in the n-th row and (n+1)-th column and a second display area PA2 disposed therebelow.

In an exemplary embodiment, at least a part of the signal lines that are not connected with any pixel and make a detour along the transmitting area TA may overlap a transmitting area (e.g., a second transmitting area), and other part may make a detour while overlapping an adjacent display area PA2. Alternatively, all of a plurality of detouring signal lines may make a detour to overlap a transmitting area (particularly, a second transmitting area).

In an exemplary embodiment, as described above, each pixel area may include eight pixels, but not being limited thereto. In such an embodiment, the number of the pixels may be variously modified or properly adjusted. In an exemplary embodiment, the data line 171 and the driving voltage line 172 are disposed in the pixel area and the transmitting area in a symmetrical form, but not being limited thereto. Alternatively, the data line 171 and the driving voltage line 172 may be disposed without being symmetrical to each other.

FIG. 13 shows a common electrode combined with the exemplary embodiment of FIG. 12. Referring to FIG. 13, in an exemplary embodiment, a plurality of data lines 171, a plurality of data lines 172, a plurality of scan lines 151, 152, and 154, and a light emission control line 153 overlapping a second pixel area PA2 may overlap a first area R1 of a common electrode 270. In such an embodiment, a plurality of data lines 171, a plurality driving voltage lines 172, a plurality of scan lines 151, 152, and 154, and a light emission control line 153 extending along a second transmitting area TA2 may overlap a third area R3 of the common electrode 270. A first transmitting area TA may overlap a second area R2 that corresponds to an opening of the common electrode 270, and transmittance with respect to a specific wavelength may be improved. In such an embodiment, since the signal lines passing through the second transmitting area TA2 are arranged along an edge of the first transmitting area TA1, the area of the first transmitting area TA1 may be effectively increased or maximized.

In exemplary embodiments, as described above, the edges of the first, second, and third areas R1, R2, and R3 of the common electrode 270 are formed in the shape of a straight line. Alternatively, as shown in FIG. 14, a common electrode 270 may have rounded edges. A first area R1 and a third area R3 of the common electrode 270 may have circular shapes, but not be limited thereto. The first area R1 and the third area R3 of the common electrode 270 may be variously modified.

Hereinafter, referring to FIG. 15 to FIG. 20, a plane shape of a pixel light emitting portion according to an exemplary embodiment will described. In an exemplary embodiment, the first pixel area and the second pixel area may include at least one or more pixel light emitting portions, which will be described with reference to FIG. 15 to FIG. 20. Alternatively, the first pixel area and the second pixel area may include a same type of pixel light emitting portions as each other or different types of pixel light emitting portions from each other. As described above, an exemplary embodiment of a pixel includes a pixel circuit portion and a pixel light emitting portion, and with reference to a cross-section described with reference to FIG. 22, the pixel circuit portion may include a plurality of wires and a conductive layer disposed between a substrate 110 and a pixel electrode 191*a*, and the pixel light emitting portion may include a pixel electrode and an emission layer.

Figure 15:
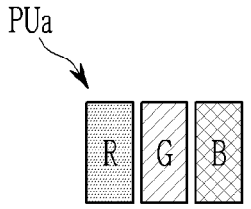
FIG. 15, FIG. 16, FIG. 17, FIG. 18, FIG. 19 and FIG. 20 respectively show pixel areas of display devices according to exemplary embodiments.

In an exemplary embodiment, referring to FIG. 15, pixel light emitting portions R, G, and B included in each pixel unit PUa may have a same shape as each other, for example, an approximately rectangular shape, and may be arranged in one direction.

Figure 16:
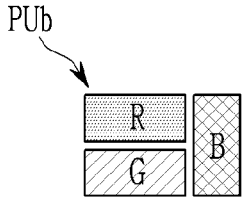

Referring to FIG. 16, in an alternative exemplary embodiment, each of the pixel light emitting portions R, G, and B included in each pixel unit PUb may have a substantially rectangular shape. Two of the three pixel light emitting portions R, G, and B, for example, a red pixel light emitting portion R and a green pixel light emitting portion G, may be vertically neighboring each other, and a blue pixel light emitting portion B, which is the remaining one of the three pixel light emitting portions, may be disposed while extending in a vertical direction at one side of each of the red and green pixel light emitting portions R and G. The red pixel light emitting portion R and the green pixel light emitting portion G may be arranged in a horizontal direction.

Figure 17:
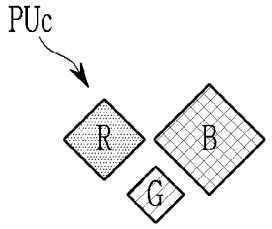

Referring to FIG. 17, in another alternative exemplary embodiment, pixel light emitting portions R, G, and B included in each pixel unit PUc may have a shape of an approximate rhombus. A red pixel light emitting portion R, a green pixel light emitting portion G, and a blue pixel light emitting portion B may be different from each other in size. In one exemplary embodiment, for example, the blue pixel light emitting portion B may be the largest and the green pixel light emitting portion G may be the smallest.

Figure 18:
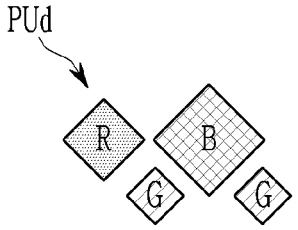

Alternatively, as shown in FIG. 18, each pixel unit PUd may include one red pixel light emitting portion R, one blue pixel light emitting portion B, and two green pixel light emitting portions G. Each of the pixel light emitting portions R, G, and B included in each pixel unit PUd may have a shape of an approximate rhombus. The red pixel light emitting portion R, the green pixel light emitting portion G, and the blue pixel light emitting portion B may be different from each other in size. In one exemplary embodiment, for example, the blue pixel light emitting portion B may be the largest, and the green pixel light emitting portion G may be the smallest.

Figure 19:
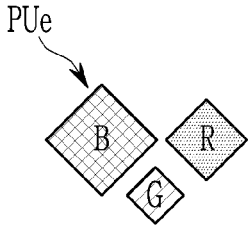
Figure 20:
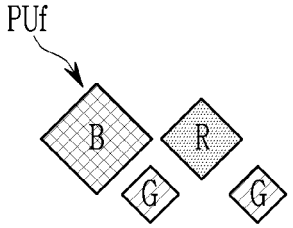

The exemplary embodiments shown in FIG. 19 and FIG. 20 are substantially the same as the exemplary embodiments described above with reference to FIG. 17 and FIG. 18, except that locations of red and blue pixel light emitting portions R and B included in pixel units PUe and PUf may be opposite to the locations of the red and blue pixel light emitting portions R and B in the pixel units PUc and PUd shown in FIG. 17 and FIG. 18.

Hereinafter, referring to FIG. 21 to FIG. 23, one pixel included in a first display area or a second display area will be described in detail.

Figure 21:
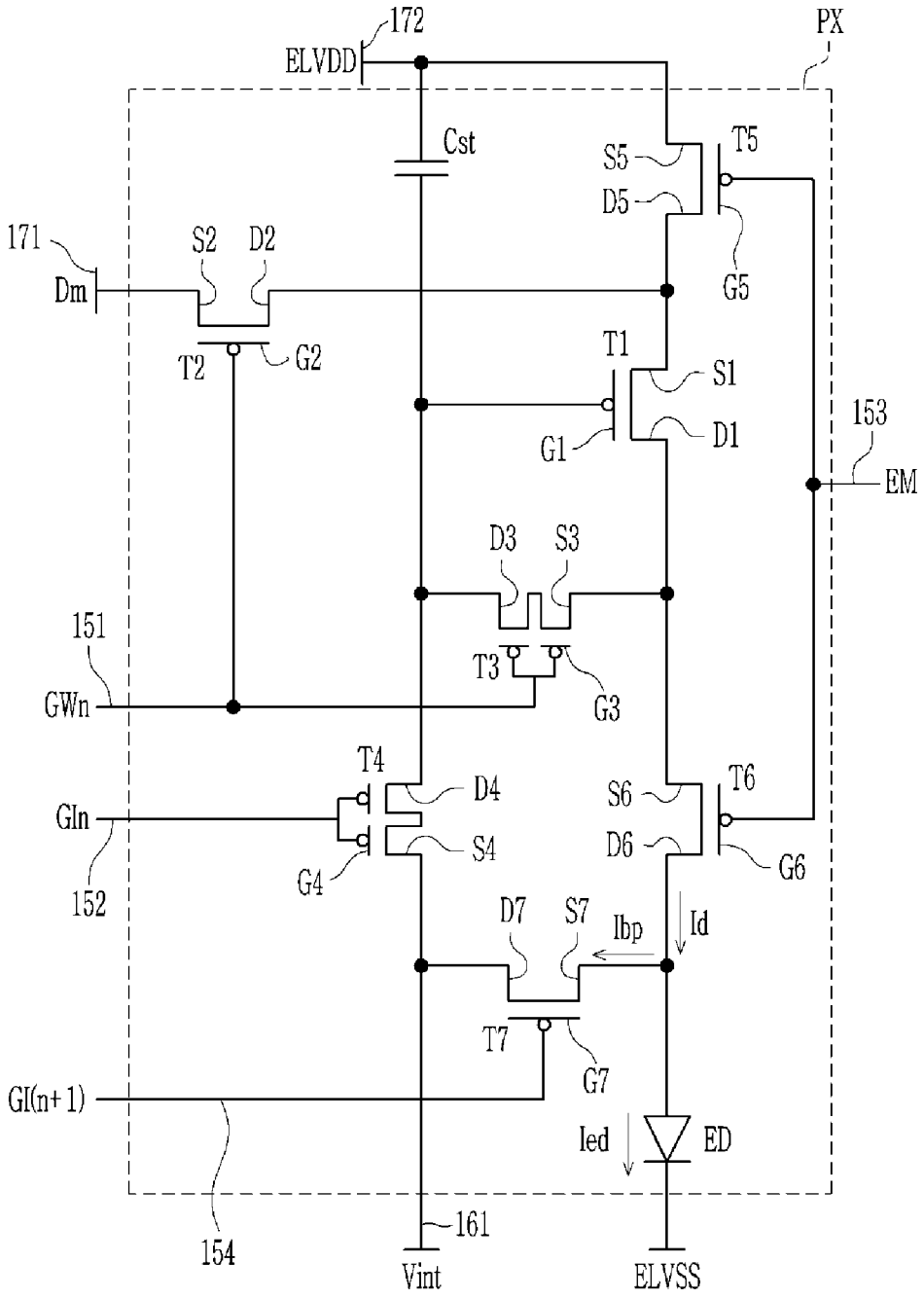
FIG. 21 is a circuit diagram of a pixel of a display device according to an exemplary embodiment.
Figure 22:
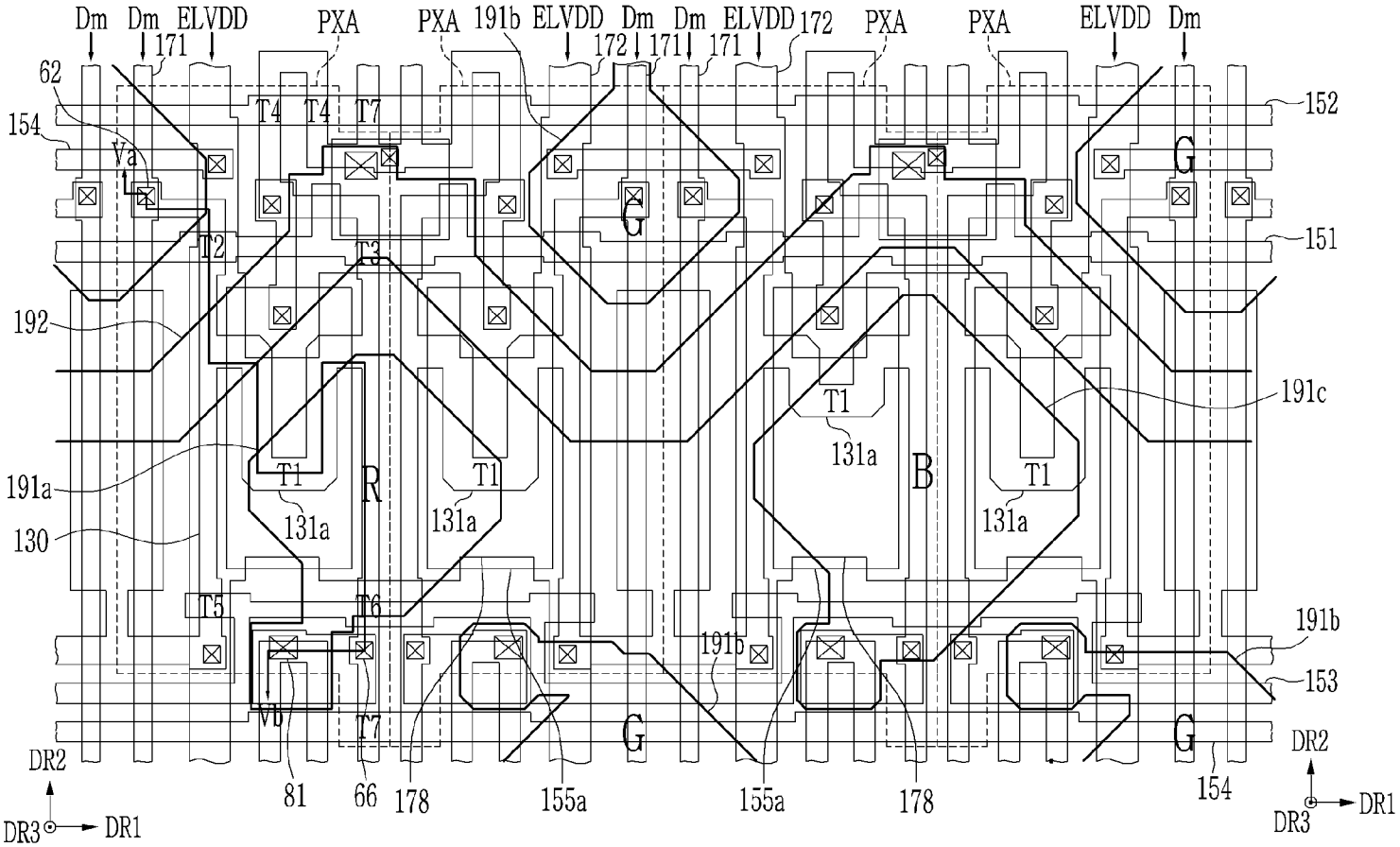
FIG. 22 is a top plan view of a plurality of pixels included in the display device according to an exemplary embodiment.
Figure 23:
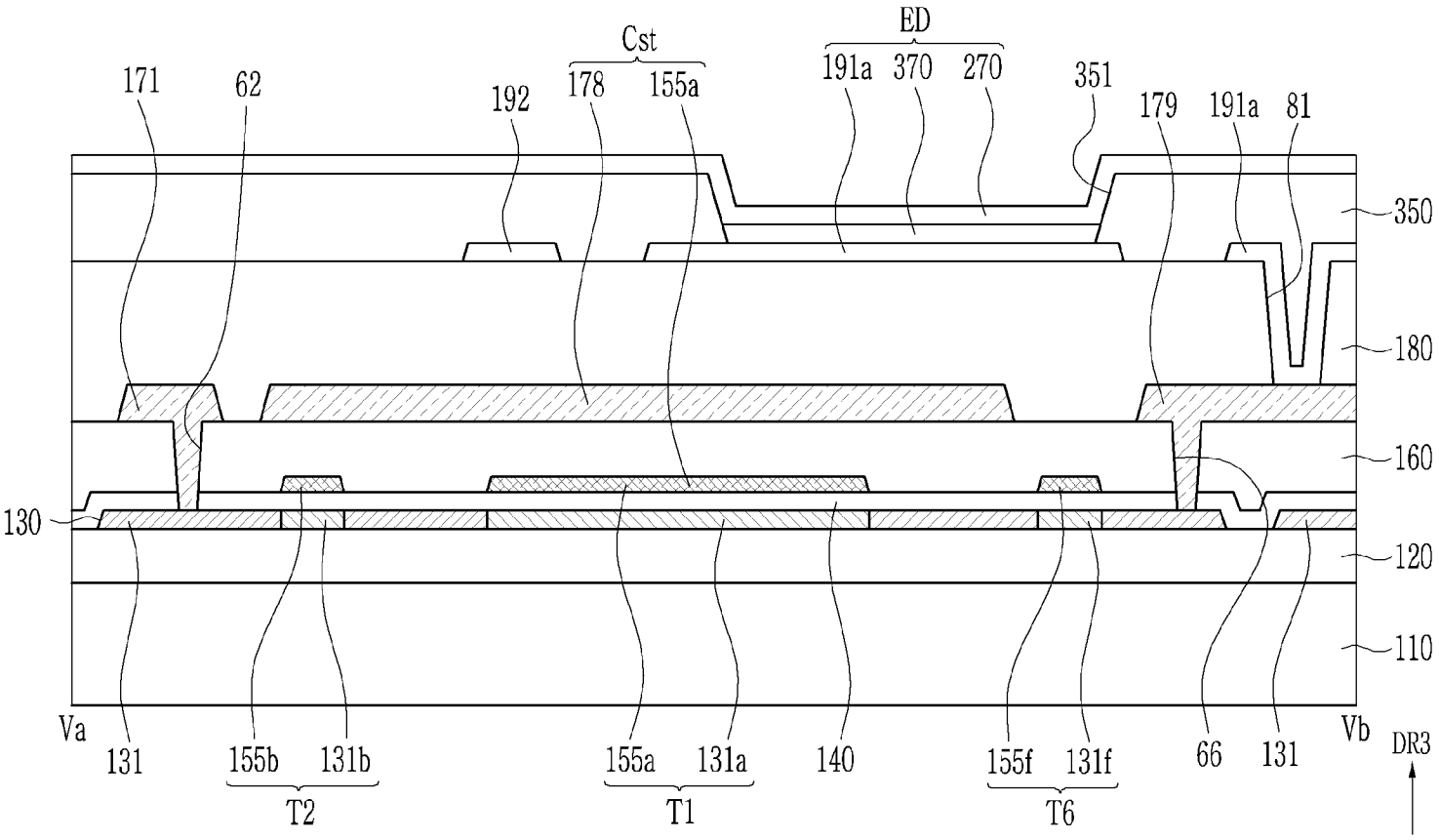
FIG. 23 is a cross-sectional view of FIG. 22, taken along line Va-Vb.

FIG. 21 is a circuit diagram of a pixel of a display device according to an exemplary embodiment, FIG. 22 is a top plan view of a plurality of pixels included in the display device according to an exemplary embodiment, and FIG. 23 is a cross-sectional view of FIG. 22, taken along line Va-Vb.

Referring to FIG. 21, an exemplary embodiment of a pixel PX may include transistors T1, T2, T3, T4, T5, T6, and T7 connected to signal lines 151, 152, 153, 154, 161, 171, and 172, a capacitor Cst, and a light emitting diode ED.

The signal lines 151, 152, 153, 154, 161, 171, and 172 may include scan lines 151, 152, and 154, a light emission control line 153, a data line 171, a driving voltage line 172, and an initialization voltage line 161.

The scan lines 151, 152, and 154 may respectively transmit scan signals GWn, GIn, and GI(n+1). The scan signals GWn, GIn, and GI(n+1) may transmit a gate-on voltage and a gate-off voltage that turn on/turn off the transistors T2, T3, T4, and T7 included in the pixel PX.

The scan lines 151, 152, and 154 connected to the pixel PX may include a first scan line 151 that may transmit the scan signal GWn, a second scan line 152 that may transmit the scan signal GIn having a gate-on voltage at different timing from that of the first scan line 151, and a third scan line 154 that may transmit the scan signal GI(n+1). The second scan line 152 may transmit the gate-on voltage at earlier timing than the first scan line 151. In one exemplary embodiment, for example, the scan signal GWn is an n-th scan signal among scan signals applied during one frame, the scan signal GIn may be a previous stage scan signal like the (n−1)-th scan signal, and the scan signal GI(n+1) may be the n-th scan signal. The scan signal GI(n+1) may be a different scan signal than the n-th scan signal.

The light emission control line 153 may transmit a light emission control signal EM that controls light emission of the light emitting diode ED. The light emission control signal EM may include a gate-on voltage and a gate-off voltage.

The data line 171 may transmit a data signal Dm. The driving voltage line 172 may transmit a driving voltage ELVDD. The data signal Dm may have a voltage level that varies based on an image signal input to the display device, and the driving voltage ELVDD may have a substantially constant level. The initialization voltage line 161 may transmit a constant voltage such as an initialization voltage Vint.

The display device may include a driving device (e.g., a scan driver, a light emission driver, a data driver, a signal controller, and the like) that generates signals transmitted to the signal lines 151, 152, 153, 154, 161, 171, and 172.

The transistors T1, T2, T3, T4, T5, T6, and T7 included in the pixel PX may include a first transistor T1, a second transistor T2, a third transistor T3, a fourth transistor T4, a fifth transistor T5, a sixth transistor T6, and a seventh transistor T7.

The first scan line 151 may transmit the scan signal GWn to the second transistor T2 and the third transistor T3. The second scan line 152 may transmit the scan signal GIn to the fourth transistor T4. The third scan line 154 may transmit the scan signal GI(n+1) to the seventh transistor T7. The light emission control line 153 may transmit the light emission control signal EM to the fifth transistor T5 and the sixth transistor T6. The transistors T1, T2, T3, T4, T5, T6, and T7 may respectively include source electrodes S1, S2, S3, S4, S5, S6, and S7, drain electrodes D1, D2, D3, D4, D5, D6, and D7, and gate electrodes G1, G2, G3, G4, G5, G6, and G7.

The first transistor T1 may receive a data signal Dm transmitted by the data line 171 and supply a driving current Id to the light emitting diode ED in response to a switching operation of the second transistor T2.

The second transistor T2 is turned on by the scan signal GWn transmitted through the first scan line 151, and thus may transmit the data signal Dm transmitted from the data line 171 to the source electrode S1 of the first transistor T1.

The third transistor T3 is turned on by the scan signal GWn transmitted through the first scan line 151, and may diode-connect the first transistor T1 by connecting the gate electrode G1 and the drain electrode D1 of the first transistor T1.

The fourth transistor T4 is turned on in response to the scan signal GIn transmitted through the second scan line 152, and transmits the initialization voltage Vint to the gate electrode G1 of the first transistor T1 such that an initialization operation for initializing a voltage of the gate electrode G1 of the first transistor T1 may be carried out.

The fifth transistor T5 and the sixth transistor T6 are simultaneously turned on in response to the light emission control signal EM transmitted through the light emission control line 153, and thus a driving voltage ELVDD is compensated through the diode-connected first transistor T1 and then transmitted to the light emitting diode ED.

The transistors T1, T2, T3, T4, T5, T6, and T7 may be P-type channel transistors such as a p-channel metal-oxide-semiconductor ("PMOS") transistor and the like, and at least one of the transistors T1, T2, T3, T4, T5, T6, and T7 may be an N-type channel transistor.

One end of the capacitor Cst may be connected with the gate electrode G1 of the first transistor T1, and the other end thereof may be connected with the driving voltage line 172. A cathode of the light emitting diode ED may be connected with a common voltage terminal that transmits a common voltage ELVSS and thus may receive the common voltage ELVSS.

The number of the transistors and the number of the capacitors included in one pixel PX, and a connection relationship thereof, may be various modified.

Operation of the display device according to an exemplary embodiment will now be simply described. When a scan signal GIn of a gate-on voltage level (the scan signal GIn may be an (n−1)-th scan signal) is supplied through the second scan line 152 through an initialization period, the fourth transistor T4 is turned on, the initialization voltage Vint is transmitted to the gate electrode G1 of the first transistor T1 through the fourth transistor T4, and the first transistor T1 is initialized by the initialization voltage Vint.

Next, when a scan signal GWn of the gate-on voltage level (the scan signal GWn may be an n-th scan signal) is supplied through the first scan line 151 during a data programming and compensation period, the second transistor T2 and the third transistor T3 are turned on. The first transistor T1 is diode-connected by the turned-on third transistor T3, and biased forward. Then, a compensation voltage which has been reduced by as much as a threshold voltage of the first transistor T1 from the data signal Dm supplied through the data line 171 is applied to the gate electrode G1 of the first transistor T1. Opposite ends of the capacitor Cst are respectively applied with the driving voltage ELVDD and the compensation voltage, and charges corresponding to a voltage difference of the opposite ends of the capacitor Cst may be stored in the capacitor Cst.

Next, when the light emission control signal EM supplied from the light emission control line 153 is changed to the gate-on voltage level from a gate-off voltage level during a light emission period, the fifth transistor T5 and the sixth transistor T6 are turned on, a driving current Id corresponding to a voltage difference between the gate voltage of the gate electrode G1 of the first transistor T1 and the driving voltage ELVDD is generated, and the driving current Id is supplied to the light emitting diode ED through the sixth transistor T6 such that a current led flows to the light emitting diode ED.

In such an embodiment, during the initialization period, the seventh transistor T7 receives a scan signal GI(n+1) of the gate-on voltage level and thus is turned on. The scan signal GI(n+1) may be the n-th scan signal. Some of the driving current Id may be drawn out through the turned-on seventh transistor T7 as a bypass current Ibp.

Next, a structure of a display device according to an exemplary embodiment will be described in detail with reference to FIG. 22 and FIG. 23. For better understanding and ease of description, stacked layers will be described in the stacked order in a cross-section, and a planar structure in each layer will be described.

Referring to FIG. 22, an exemplary embodiment of a display device may include a pixel circuit portion and a pixel light emitting portion included in a plurality of pixels R, G, and B. The plurality of pixels may be arranged substantially in a matrix form in a first direction DR1 and a second direction DR2. As described above, the pixel includes the pixel circuit portion and the pixel light emitting portion, and with reference to a cross-section described in FIG. 23, the pixel circuit portion may include a plurality of wires and a conductive layer disposed between a substrate 110 and a pixel electrode 191*a*, and the pixel light emitting portion may include a pixel electrode and an emission layer.

Each pixel may include a plurality of transistors T1, T2, T3, T4, T5, T6, and T7 connected with a plurality of scan lines 151, 152, and 154, a light emission control line 153, a data line 171, and a driving voltage line 172.

The plurality of scan lines 151, 152, and 154 may transmit a scan signal. The scan line 152 may transmit a scan signal of the previous stage, and the scan line 154 may transmit a scan signal of the next stage. The light emission control line 153 may transmit a control signal, e.g., a light emission control signal to control light emission of light emitting diodes corresponding to the pixels R, G, and B.

The data line 171 may transmit a data signal Dm, and the driving voltage line 172 may transmit a driving voltage ELVDD. The driving voltage line 172 may include a plurality of expansion portions 178 expanded by protruding in the first direction DR1.

Each channel of the plurality of transistors T1, T2, T3, T4, T5, T6, and T7 may be formed in an active pattern 130. The active pattern 130 may be curved in various shapes, and may include a semiconductor material such as amorphous/polysilicon or an oxide semiconductor. In one exemplary embodiment, for example, the transistor T1 may include a channel region 131*a* of an active pattern 130 that is bent at least once.

An exemplary embodiment of the display device may include a plurality of pixel electrodes 191*a*, 191*b*, and 191*c* respectively corresponding to the pixels, and a voltage line 192. Each of the pixel electrodes 191*a*, 191*b*, and 191*c* may be located corresponding to each of the pixels R, G, and B.

A pixel electrode 191*a* of the red pixel R may have a smaller sizer (or area) than a pixel electrode 191*c* of the blue pixel B in a plan view, and a pixel electrode 191*b* of the green pixel G may have a smaller size than the pixel electrode 191*a* of the red pixel R in a plan view.

The voltage line 192 may be bent along the periphery of edges of adjacent pixel electrodes 191*a*, 191*b*, and 191*c*, and may transmit a constant voltage such an initialization voltage that initializes a node of a pixel.

A cross-sectional structure of an exemplary embodiment of the display device will be described with reference to FIG. 23, together with FIG. 22.

In an exemplary embodiment, the display device may include the substrate 110.

A buffer layer 120, which is an insulation layer, may be disposed on the substrate 110, and the active pattern 130 may be disposed on the buffer layer 120. The active pattern 130 may include channel regions 131*a*, 131*b*, and 131*f* and a conductive region 131. The conductive region 131 is disposed at opposite sides of each of the channel regions 131*a*, 131*b*, and 131*f*, and may become a source region and a drain region of the corresponding transistor.

A gate insulation layer 140 may be disposed on the active pattern 130.

A first conductive layer including the plurality of scan lines 151, 152, and 154, the light emission control line 153, a driving gate electrode 155*a* and the like (e.g., gate electrodes 155*b* and 155*f* of the transistors T2 and T6) may be disposed on the gate insulation layer 140.

An interlayer insulation layer 160 may be disposed on the first conductive layer and the gate insulation layer 140.

At least one of the buffer layer 120, the gate insulation layer 140, and the interlayer insulation layer 160 may include an inorganic insulation material such as a silicon nitride, a silicon oxide, a silicon oxynitride, and the like, or an organic insulation material.

A contact hole 62 is defined through the interlayer insulation layer 160 and the gate insulation layer 140 to overlap a source region that is connected to the channel region 131*b* of the transistor T2 in the conductive region 131 of the active pattern 130, and a contact hole 66 is defined through the interlayer insulation layer 160 and the gate insulation layer 140 to overlap a drain region that is connected to the channel region 131*f* of the transistor T6 in the conductive region 131 of the active pattern 130.

A second conductive layer including the data line 171, the driving voltage line 172, and a connection member 179 may be disposed on the interlayer insulation layer 160.

The data line 171 may be connected with a source region that is connected to the channel region 131*b* of the transistor T2 through the contact hole 62. The expansion portion 178 of the driving voltage line 172 may form a capacitor Cst by overlapping the driving gate electrode 155*a*, while disposing the interlayer insulation layer 160 therebetween. The connecting member 179 may be connected with a drain region connected to the channel region 131*f* of the transistor T6 through the contact hole 66.

At least one of the first conductive layer and the second conductive layer may include a metal such as copper (Cu), aluminum (Al), molybdenum (Mo), titanium (Ti), tantalum (Ta), and an alloy of at least two of them.

A passivation layer 180 may be disposed on the second conductive layer and the interlayer insulation layer 160. The passivation layer 180 may include an organic insulation material such as a poly-acrylic resin, a polyimide resin, and the like, and a top surface of the passivation layer 180 may be substantially flat. A contact hole 81 may be defined through the passivation layer 180 to overlap the connection member 179.

A third conductive layer including the pixel electrodes 191*a*, 191*b*, and 191*c* and the voltage line 192 may be disposed on the passivation layer 180. Each of the pixel electrodes 191*a*, 191*b*, and 191*c* may be connected with the connection member 179 through the contact hole 81. The third conductive layer may include a semi-transmissive conducting material or a reflective conducting material.

An insulation layer 350 may be disposed on the third conductive layer. The insulation layer 350 may include an organic insulating material, and an opening 351 may be defined through the insulation layer 350 to overlap the respective pixel electrodes 191*a*, 191*b*, and 191*c*.

An emission layer 370 may be disposed on the pixel electrodes 191*a*, 191*b*, and 191*c*. The emission layer 370 may include a portion disposed inside the opening 351, and a portion disposed above the insulation layer 350. The emission layer 370 may include an organic light emitting material or an inorganic light emitting material.

A common electrode 270 may be disposed on the emission layer 370 and the insulation layer 350. The common electrode 270 may include a conductive transparent material. The common electrode 270 may include silver (Ag).

A common layer such as a hole injection layer, a hole transport layer, an electron injection layer, an electron transport layer, and the like may be disposed between the insulation layer 350 and the common electrode 270, between the emission layer 370 and the common electrode 270, and/or between the emission layer 370 and the pixel electrodes 191*a*, 191*b*, and 191*c*. The common layer may be disposed to cover the entire first and second display areas DA1 and DA2.

Each of the pixel electrodes 191*a*, 191*b*, and 191*c*, the emission layer 370, and the common electrode 270 collectively define a light emitting diode ED, which is a light emission element. The common electrode 270 may be a cathode and the pixel electrodes 191*a*, 191*b*, and 191*c* may be an anode, or vice versa.

A pixel area of the first display area DA1 and the second display area DA2 may have a structure of a pixel area PXA shown in FIG. 22 and FIG. 23.

In the transmitting area TA, at least a part of the structure shown in FIG. 22 and FIG. 23, for example, at least a part of the active pattern 130, the driving gate electrode 155*a*, the expansion portion 178 of the driving voltage line 172, the pixel electrodes 191*a*, 191*b*, and 191*c*, and the emission layer 370, may be omitted. Accordingly, in such an embodiment, transmittance in the transmitting area TA may be higher than transmittance in the pixel areas PA1 and PA2.

While the invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A display device comprising:

a substrate including a first display area and a second display area;

a signal line which overlaps the first display area and the second display area; and a common electrode which overlaps the first display area and the second display area, wherein the first display area comprises a first pixel area, the second display area comprises a second pixel area and a transmitting area, the transmitting area comprises a first transmitting area and a second transmitting area, which have different transmittances from each other, the common electrode overlaps the first pixel area, the second pixel area, and the second transmitting area, and in the second transmitting area, at least a part of the signal line and the common electrode overlap each other, wherein the common electrode comprises:

a first area overlapping at least one of the first pixel area and the second pixel area;

a second area overlapping the first transmitting area; and a third area disposed between the first area and the second area, and overlapping the second transmitting area.

2. The display device of claim 1, wherein a thickness of a portion of the common electrode corresponding to the third area is about 10% to about 90% of a thickness of a portion of the common electrode corresponding to the first area.

3. The display device of claim 1, wherein the third area surrounds edges of the first transmitting area.

4. The display device of claim 1, wherein an opening is defined through the common electrode to overlap the first transmitting area.

5. The display device of claim 1, wherein the signal line comprises a scan line and a light emission control line, which extend along a first direction, and at least a part of the scan line and the light emission control line overlaps the third area.

6. The display device of claim 5, wherein at least a part of the scan line and the light emission control line alternately overlaps the first area and the third area.

7. The display device of claim 5, wherein the second pixel area and the transmitting area are alternately arranged along the first direction, and at least a part of the scan line and the light emission control line extends to overlap the second transmitting area while crossing the second pixel area.

8. The display device of claim 5, wherein the signal line comprises a data line and a driving voltage line, which extend along a second direction different from the first direction, and at least a part of the data line and the driving voltage line overlaps the third area.

9. The display device of claim 8, wherein at least a part of the data line and the driving voltage line alternately overlaps the first area and the third area.

10. The display device of claim 8, wherein the second pixel area and the transmitting area are alternately arranged along the second direction, and at least a part of the data line and the driving voltage line extends to overlap the second transmitting area, while crossing the second pixel area.

11. The display device of claim 1, wherein each of the first pixel area and the second pixel area comprises:

a first pixel which displays a first color;

a second pixel which displays a second color different from the first color; and a third pixel which displays a third color different from the first color and the second color.

12. The display device of claim 11, wherein each of the first pixel area and the second pixel area comprises:

at least two first pixels;

at least four second pixels; and at least two third pixels.

13. The display device of claim 11, wherein at least two of the first pixel, the second pixel, and the third pixel are different from each other in size.

14. The display device of claim 1, wherein the common electrode overlapping the first display area has a continuous shape.

15. The display device of claim 1, wherein a plane size of the transmitting area and a plane size of the second pixel area are substantially the same as each other.

16. A display device comprising:

a substrate including a first display area and a second display area;

a signal line which overlaps the first display area and the second display area;

a common electrode which overlaps the first display area and the second display area; and an optical member which overlaps the second display area, wherein the first display area comprises a first pixel area, the second display area comprises a second pixel area and a transmitting area, the transmitting area comprises a first transmitting area and a second transmitting area, which have different transmittances from each other, an opening is defined through the common electrode to overlap the first transmitting area and the common electrode overlaps the second transmitting area, and at least a part of the signal line and the common electrode overlap each other in the second transmitting area, wherein the common electrode comprises:

a first area overlapping at least one of the first pixel area and the second pixel area;

a second area overlapping the first transmitting area and comprising an opening; and a third area disposed between the first area and the second area, and overlapping the second transmitting area.

17. The display device of claim 16, wherein a thickness of a portion of the common electrode corresponding to the third area is about 10% to about 90% of a thickness of a portion of the common electrode corresponding to the first area.

18. The display device of claim 16, wherein at least a part of the signal line alternately overlaps the first area and the third area.

* * * * *